US006400340B1

(12) United States Patent
Nishida

(10) Patent No.: US 6,400,340 B1
(45) **Date of Patent: *Jun. 4, 2002**

(54) DISPLAY DEVICE

(75) Inventor: Shinsuke Nishida, Tokyo (JP)

(73) Assignee: Fourie Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/696,824

(22) Filed: Oct. 26, 2000

Related U.S. Application Data

(62) Division of application No. 08/952,135, filed as application No. PCT/JP96/00789 on Mar. 26, 1996.

(51) Int. Cl.[7] ..... G09G 5/00
(52) U.S. Cl. ..... 345/1.1; 345/4; 345/903
(58) Field of Search ..... 345/1, 4, 903, 345/204, 970, 112, 115, 654, 698, 692, 619, 1.1

(56) References Cited

U.S. PATENT DOCUMENTS

| | | | | | |
|---|---|---|---|---|---|
| 4,186,394 | A | | 1/1980 | Bobak et al. | 345/764 |
| 4,771,278 | A | | 9/1988 | Pooley | 340/780 |
| 4,901,155 | A | * | 2/1990 | Hara et al. | 358/230 |
| 5,523,769 | A | * | 6/1996 | Lauer et al. | 345/1.1 |
| 5,528,740 | A | * | 6/1996 | Hill et al. | 395/128 |
| 5,663,739 | A | * | 9/1997 | Pommerenke et al. | 345/1 |
| 5,805,117 | A | * | 9/1998 | Mazurek et al. | 345/1 |
| 6,208,319 | B1 | * | 3/2001 | Nishida | 345/1 |

FOREIGN PATENT DOCUMENTS

| | | |
|---|---|---|
| EP | 0241989 | 10/1987 |
| EP | 0544510 | 6/1993 |
| EP | 0782124 | 7/1997 |
| EP | 0782184 | 7/1997 |
| EP | 0810578 | 12/1997 |
| FR | 2526568 | 11/1983 |
| JP | 5579492 | 6/1980 |
| JP | 6235393 | 2/1987 |
| JP | 1103874 | 12/1989 |
| JP | 4190285 | 7/1992 |
| JP | 499346 | 8/1992 |

OTHER PUBLICATIONS

"Kleine Enzyklopadie Mathematik", Veb Bibliographisches Institut Leipzig, (1979) p. 742.

* cited by examiner

*Primary Examiner*—Bipin Shalwala
*Assistant Examiner*—Mansour M. Said
(74) *Attorney, Agent, or Firm*—Ladas & Parry

(57) ABSTRACT

A large number of display elements having a function to change a display state of a pixel by supplying electric power are arranged in a matrix form to constitute a two-dimensional pixel arrangement, and a controller for changing display states of these plural display elements is prepared. Several divisional modes indicated by divisional levels n are defined and the two-dimensional pixel arrangement is divided by $2^n$ in length and breadth directions so as to obtain $2^{2n}$ blocks. In the divisional level n=1, four blocks are obtained which are respectively indicated by addresses consisting of 2 bits of 00, 01, 10, 11. In the divisional level n=i, $2^{2i}$ blocks are obtained which are respectively indicated by addresses obtained by adding any two bits of 00, 01, 10, 11 to the low sides of the addresses of $2^{2(i-1)}$ blocks of the divisional level n=(i−1). When the controller receives a display signal consisting of a divisional level, an address and a data, a particular block is selected among the plural blocks which are defined by a division of the divisional level. The controller changes a display state of display elements belonging to the particular block to a new state indicated by the data.

9 Claims, 14 Drawing Sheets

Fig.1

| DIVISIONAL LEVEL n | DIVISIONAL MODE | NO. OF BITS REQUIRED FOR ADDRESS (2 n) | DISPLAY RESOLUTION ($2^{2n}$) |
|---|---|---|---|
| n = 0 | | 0 | 1 |
| n = 1 | a 00, b 01, c 10, d 11 | 2 | 4 |
| n = 2 | e 0000, f 0001, 0100, 0101, g 0010, h 0011, 0110, 0111, 1000, 1001, 1100, 1101, 1010, 1011, 1110, 1111 | 4 | 16 |
| n = 3 | 000000, 010000, 010101, i, 110000, 100000, 101010, 111111 | 6 | 64 |

| DIVISIONAL LEVEL | ADDRESS | DATA |
|---|---|---|
| 0 0 0 1 | 0 0 | 1 |

| DIVISIONAL LEVEL | ADDRESS | DATA |
|---|---|---|
| 0 0 1 0 | 0 1 1 0 | 1 |
| 0 0 1 0 | 1 0 0 1 | 1 |
| 0 0 1 0 | 1 1 0 1 | 1 |
| 0 0 1 0 | 1 1 1 0 | 1 |

| DIVISIONAL LEVEL | ADDRESS | DATA |
|---|---|---|
| 0 0 1 1 | 0 1 1 1 1 0 | 1 |
| 0 0 1 1 | 1 0 1 1 0 1 | 1 |
| 0 0 1 1 | 1 1 1 1 0 0 | 1 |

| DIVISIONAL LEVEL | ADDRESS | DATA |
|---|---|---|
| 0 0 0 1 | 0 0 | 0 |

| DIVISIONAL LEVEL | ADDRESS | DATA |
|---|---|---|
| 0 0 1 1 | 0 0 1 1 1 1 | 1 |

| DIVISIONAL LEVEL | ADDRESS | DATA |
|---|---|---|
| 0 0 0 0 | | 1 |

| DIVISIONAL LEVEL | ADDRESS | DATA |
|---|---|---|
| 0 0 1 0 | 1 1 0 0 | 0 |

| COMMAND NO. | DIVISIONAL LEVEL | ADDRESS / DATA |
|---|---|---|
| 1 | 0 0 1 | 1 0 0 0 0 0 0 0 1 |
| 2 | 0 0 1 | 1 1 0 0 0 0 0 0 1 |
| 3 | 0 1 0 | 0 0 1 0 0 0 0 0 1 |
| 4 | 0 1 1 | 0 0 0 0 1 1 0 0 1 |
| 5 | 0 1 1 | 0 1 1 0 1 0 0 0 1 |
| 6 | 0 1 1 | 0 1 1 0 1 1 0 0 1 |
| 7 | 1 0 0 | 0 1 1 0 0 0 0 1 1 |
| 8 | 1 0 0 | 0 1 1 0 0 0 1 1 1 |
| 9 | 1 0 0 | 0 1 1 0 0 1 0 0 1 |
| 10 | 1 0 0 | 0 1 1 0 0 1 1 0 1 |

| COMMAND NO. | DIVISIONAL LEVEL | ADDRESS / DATA |
|---|---|---|
| 1 | 0 1 0 | 0 1 1 0 0 0 0 0 0 |
| 2 | 0 1 1 | 0 1 1 0 0 1 0 0 1 |
| 3 | 0 1 1 | 0 1 1 0 1 1 0 0 1 |
| 4 | 1 0 0 | 0 1 1 0 1 0 0 1 1 |
| 5 | 1 0 0 | 0 1 1 0 1 0 1 1 1 |
| 6 | 1 0 0 | 0 1 1 1 1 0 0 0 1 |
| 7 | 1 0 0 | 0 1 1 1 1 0 1 0 1 |
| 8 | | |
| 9 | | |
| 1 0 | | |

Fig.16A
210
| | | | |
|---|---|---|---|
| 0000 | 0001 | 0100 | 0101 |
| 0010 | 0011 | 0110 | 0111 |
| 1000 | 1001 | 1100 | 1101 |
| 1010 | 1011 | 1110 | 1111 |
Fig.16B
220
| | |
|---|---|
| 00 | 01 |
| 10 | 11 |
Fig.17
| COMMAND NO. | DIVISIONAL LEVEL | ADDRESS | DATA |
|---|---|---|---|
| 1 | 0 0 0 1 | 0 0 | 1 |
| 2 | 0 0 0 1 | 1 1 | 1 |
Fig.18A
210
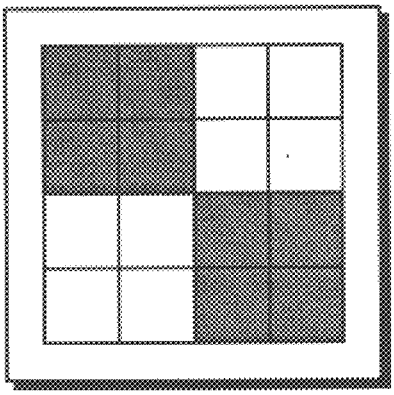
Fig.18B
220
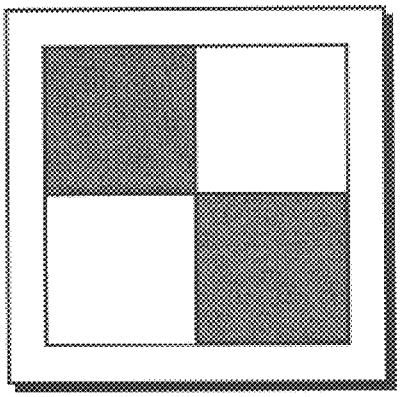

Fig.19
| COMMAND NO. | DIVISIONAL LEVEL | ADDRESS | DATA |
|---|---|---|---|
| 1 | 0 0 1 0 | 0 0 0 1 | 1 |
| 2 | 0 0 1 0 | 0 0 1 0 | 1 |
| 3 | 0 0 1 0 | 0 0 1 1 | 1 |
| 4 | 0 0 1 0 | 1 0 0 1 | 1 |
| 5 | 0 0 1 0 | 1 1 0 0 | 1 |
| 6 | 0 0 1 0 | 1 1 1 1 | 1 |
Fig.20A
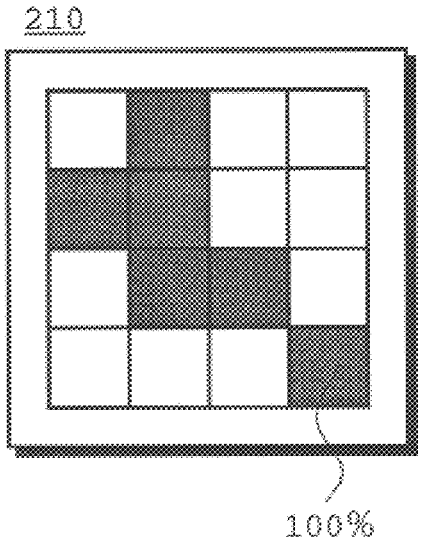
Fig.20B
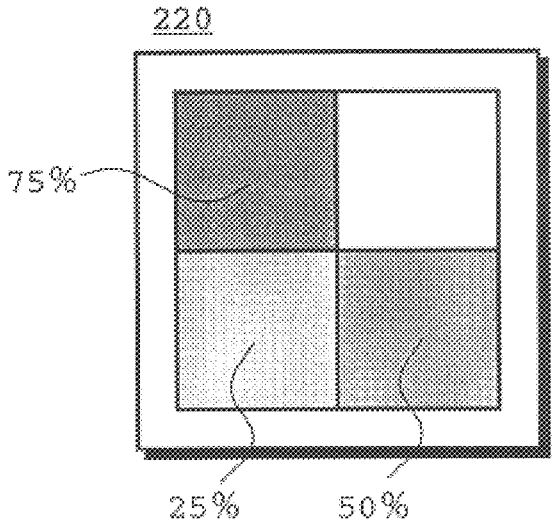

Fig.21A
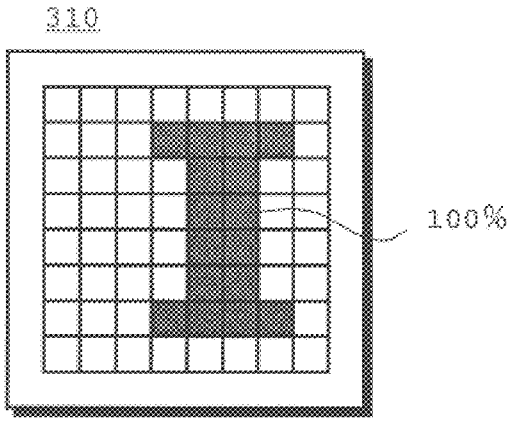
Fig.21B
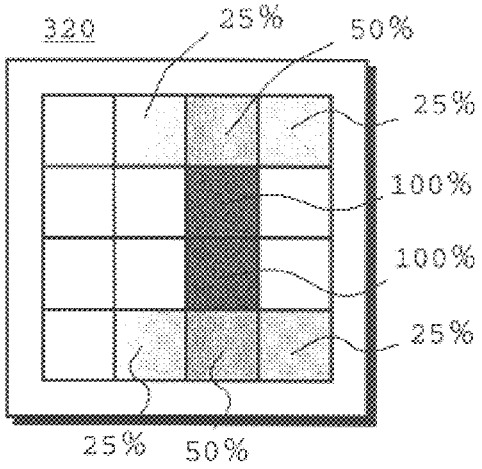
Fig.21C
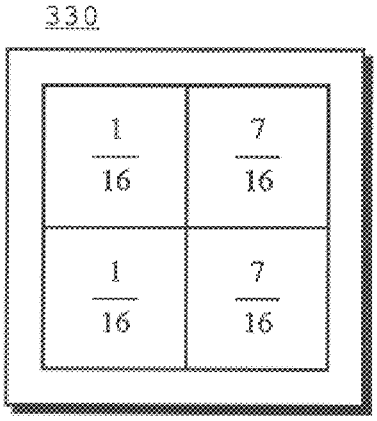
Fig.21D
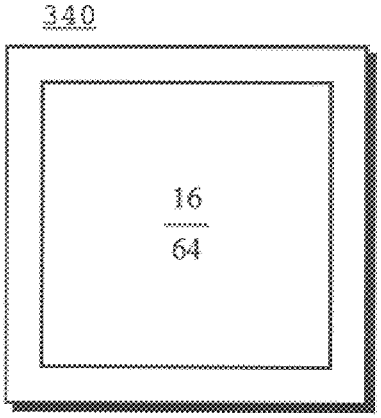
Fig.22
| COMMAND NO. | DIVISIONAL LEVEL | ADDRESS | DATA |
|---|---|---|---|
| 1 | 0 0 1 1 | 0 0 0 1 1 1 | 1 |
| 2 | 0 0 1 1 | 0 1 0 0 1 0 | 1 |
| 3 | 0 0 1 1 | 0 1 0 0 1 1 | 1 |
| 4 | 0 0 1 1 | 0 1 0 1 1 0 | 1 |
| 5 | 0 0 1 0 | 0 1 1 0 | 1 |
| 6 | 0 0 1 0 | 1 1 0 0 | 1 |
| 7 | 0 0 1 1 | 1 0 1 1 0 1 | 1 |
| 8 | 0 0 1 1 | 1 1 1 0 0 0 | 1 |
| 9 | 0 0 1 1 | 1 1 1 0 0 1 | 1 |
| 10 | 0 0 1 1 | 1 1 1 1 0 0 | 1 |

Fig.23

| | COMMAND NO. | DIVISIONAL LEVEL | ADDRESS | DATA |
|---|---|---|---|---|
| DIVISIONAL LEVEL 0 | 1 | 0000 | | 0010000 |
| | 2 | 0001 | 00 | 00001 |
| DIVISIONAL LEVEL 1 | 3 | 0001 | 01 | 00111 |
| | 4 | 0001 | 10 | 00001 |
| | 5 | 0001 | 11 | 00111 |
| | 6 | 0010 | 0000 | 000 |
| | 7 | 0010 | 0001 | 001 |
| | 8 | 0010 | 0010 | 000 |
| | 9 | 0010 | 0011 | 000 |
| | 10 | 0010 | 0100 | 010 |
| | 11 | 0010 | 0101 | 001 |
| | 12 | 0010 | 0110 | 100 |
| DIVISIONAL LEVEL 2 | 13 | 0010 | 0111 | 000 |
| | 14 | 0010 | 1000 | 000 |
| | 15 | 0010 | 1001 | 000 |
| | 16 | 0010 | 1010 | 000 |
| | 17 | 0010 | 1011 | 001 |
| | 18 | 0010 | 1100 | 100 |
| | 19 | 0010 | 1101 | 000 |
| | 20 | 0010 | 1110 | 010 |
| | 21 | 0010 | 1111 | 001 |
| | 22 | 0011 | 000000 | 0 |
| | 23 | 0011 | 000001 | 0 |
| DIVISIONAL LEVEL 3 | ⋮ | ⋮ | ⋮ | ⋮ |

DISPLAY SIGNAL (COMMAND)

DISPLAY DEVICE

This application is a divisional of application Ser. No. 08/952,135 filed on Nov. 6, 1997, which is International Application PCT/JP96/00789 filed on Mar. 26, 1996 and which designated the U.S., claims the benefit thereof and incorporates the same by reference.

TECHNICAL FIELD

The present invention relates to a display device, especially to a type of display device which is attached on a wall, such as an electric bulletin board, an advertisement sign board or the like.

BACKGROUND ART

Wall display devices, such as electric bulletin boards and advertisement sign boards, are widely used as means for providing information to many and unspecific people on streets. Such a wall display device usually includes a number of display elements arranged on a plane to form a two-dimensional matrix array of pixels in which an individual element is used for a pixel. The respective display elements are electrically actuated in various manner to display information. In an electric bulletin board, for example, one light bulb is used as one display element for one pixel, and a plurality of the light bulbs are arranged in matrix. By illuminating those of the light bulbs in specified positions, it is possible to display letters and pictures. Recently electric bulletin boards using light emitting diodes in place of light bulbs are widely used.

In an advertisement sign board, "panel display elements" are used as display elements to constitute respective pixels. The "panel display elements" are not light emitting themselves but have a plurality of display faces only one of which is actually displayed. Usually one of the display faces to be displayed can be selected by using a rotary mechanism, such as a motor or the like. One display face is selected for each pixel, whereby letters or pictures can be displayed.

Display elements for respective pixels, which are thus provided by light bulbs, light emitting diodes, panel display elements or the like, are electrically actuated. The light bulbs and the light emitting diodes, for example, can be switched between their light emitting state and non-light emitting state by On/Off control of electric power supply. By conducting the On/Off control on the respective light bulbs or the respective light emitting diodes which provide respective pixels, only required pixels can be selectively illuminated, whereby required information can be displayed. In the panel display elements the On/Off control of electric power supply to the motor is conducted, whereby those of the display faces to be actually displayed can be selected. The On/Off control is conducted on the respective panel display elements providing the respective pixels, whereby a required display face for each pixel can be displayed and required information can be displayed.

In the above-described display devices, needless to say, larger numbers of pixels are necessary for improvement of their display resolution. Accordingly it is necessary that a large number of display elements for respective pixels are arranged in a matrix. However, in order to increase a number of display elements, a number of wiring lines for the display elements must be increased. Therefore, a structure of a display device becomes complicated, which need much labor for its manufacture and maintenance. This results in higher manufacturing costs and maintenance costs.

In order to solve such problems, in the International Application No. PCT/JP95/00901 based on the Patent Cooperation Treaty, there is disclosed a novel technology in which a large number of display units having address recognition function are arranged in a matrix form to thereby constitute a display device. In this novel display device, since respective display units have address recognition function, it is possible to respectively independently control individual display units by a common signal through a common transmission passage. Accordingly, even if the number of display elements is increased, there is no possibility that wiring becomes complicated. Namely, if a particular display instruction is to be given to a specific display unit, it is sufficient to give such a display instruction along with address information indicating this specific display unit. When such an approach is employed, even if a common signal transmission passage is used as wiring for the respective display units, the individual display units can judge, by making reference to the address information, whether or not the given display instruction is directed to themselves.

In addition, in the International Application No. PCT/JP96/00058 based on the Patent Cooperation Treaty, there is disclosed a novel display device providing individual display units with memories in which respective display operations are stored in advance. In this display device, since the display units store respective own display operations for themselves in advance, it is possible to execute the display operations stored in advance even if no instruction is given from the external.

An object of this invention is to provide a novel technique for more efficiently operating a display device which provides a large number of display elements in a matrix form corresponding to respective pixels to constitute a two-dimensional pixel arrangement, wherein the respective display elements are driven by electric power to vary their display state.

DISCLOSURE OF INVENTION (1) A first feature of the invention resides in a display device in which a plurality of display elements are arranged in a matrix form to constitute a two-dimensional pixel arrangement so as to display information on the two-dimensional pixel arrangement, each of the display elements having a function to change a display state of a pixel by applying electric power, the display device comprising:

a device body including plural display elements for constituting the two-dimensional pixel arrangement and a controller for changing display states of the plural display elements;

an electric power source for delivering electric power to the display elements; and a control unit for delivering a display signal for designating display states of the display elements;

wherein plural kinds of divisional modes for dividing the two-dimensional pixel arrangement into plural blocks are defined, the respective divisional modes being represented by divisional level information indicating fineness of division, and address information for indicating the respective blocks are defined for the respective divisional modes;

wherein the control unit delivers, to the controller, a display signal including divisional level information, address information and data information; and wherein, when the display signal is supplied to the controller, the controller executes a display operation for changing a display state of a display element or elements belonging to a particular block indicated by the address information so that the display state is changed to a new state indicated by the data information, the particular block being selected from among the plural blocks which are obtained when the two-dimensional pixel arrangement is divided by a divisional mode indicated by the divisional level information.

(2) A second feature of the invention resides in a display device having the first feature:

wherein a divisional mode indicated by a divisional level n is defined in which the two-dimensional pixel arrangement is divided by $2^n$ in length and breadth directions so that $2^{2n}$ number of blocks are obtained and N kinds of divisional modes are defined with respect to n=1, 2, . . . , i, . . . N.

(3) A third feature of the invention resides in a display device having the second feature:

wherein, with respect to four blocks obtained in a divisional mode indicated by a divisional level n=1, they are respectively indicated by addresses consisting of 2 bits of 00, 01, 10, 11; and wherein, with respect to $2^{2i}$ blocks obtained in a divisional mode indicated by a divisional level n=i, they are respectively indicated by addresses obtained by adding any one of 00, 01, 10, 11 to low order sides of addresses indicating $2^{2(i-1)}$ blocks obtained in a divisional mode indicated by a divisional level n=(i−1).

(4) A fourth feature of the invention resides in a display device having the third feature:

wherein divisional level information, address information and data information are respectively represented by bit or bits, a bit length of the divisional level information being fixed and a sum of a bit length of the address information and a bit length of the data information being fixed, and the bit length of the address information is recognized on the basis of the divisional level information.

(5) A fifth feature of the invention resides in a display device having any one of the first to the fourth features:

wherein when the two-dimensional pixel arrangement is divided based on a divisional mode finer than a display element so that portions of a display element respectively belong to plural different blocks, an operation to obtain uniformed combined data information is executed on the basis of respective data information corresponding to the plural different blocks and a display state of the display element is changed on the basis of the combined data information.

(6) A sixth feature of the invention resides in a display device having the fifth feature:

wherein in a time period during which an operation for obtaining uniformed combined data information is executed on the basis of a first display signal delivered for a purpose of changing a display state of a specific display element, when a second display signal for a purpose of changing a display state of the specific display element is delivered and the second display signal indicates a division coarser than that of the first display signal, the operation based on the first display signal is stopped and a new operation based on the second display signal is executed.

(7) A seventh feature of the invention resides in a display device having any one of the first to the sixth features:

wherein the control unit delivers a display signal including divisional level information, address information, data information and a time code; and wherein the controller is operative so that when it is supplied with the display signal, it changes a display state at a timing synchronous with the time code.

(8) An eighth feature of the invention resides in a display device having the seventh feature:

wherein when the controller is supplied with plural display signals including a same time code and different divisional levels from each other, the controller selects a display signal having a divisional level in conformity with a number of display elements constituting the two-dimensional pixel arrangement among the plural display signals and executes only an operation based on the selected display signal.

(9) A ninth feature of the invention resides in a display device having any one of the first to the eighth features:

wherein the control unit generates plural display signals different in divisional levels on the basis of a same picture image and delivers the plural display signals in order from a display signal coarse in division to a display signal fine in division.

(10) A tenth feature of the invention resides in a display device having any one of the first to the eighth features:

wherein the control unit generates a display signal for a portion of a screen where a change takes place with respect to a series of picture images and delivers the display signal to the controller to provide a moving picture.

(11) An eleventh feature of the invention resides in a display device having any one of the first to the tenth features:

wherein plural display units are provided to constitute a device body, each of the display units including display elements, control elements for controlling an electric power supply to the display elements, memory means for storing predetermined address information, and a controller for controlling the control elements on the basis of address information stored in the memory means and a display signal delivered from a control unit; and wherein different address information is stored in the respective memory means of the respective display units, and each of the controllers is operative so that when address information stored in the memory means and address information within the delivered display signal are in correspondence with each other it controls the control elements on the basis of data information within the delivered display signal.

BRIEF DESCRIPTION OF THE DRAWINGS

FIG. 1 is a view showing four kinds of divisional modes for dividing two-dimensional pixel arrangement into plural blocks, and addresses defined with respect to respective blocks obtained in the individual divisional modes.

FIGS. 16A and 16B are views respectively showing examples of display devices having different resolutions from each other.

FIG. 17 is a view showing an example of display signal delivered to the display devices shown in FIGS. 16A and 16B.

FIGS. 18A and 18B are views respectively showing display states in the case where the display signal shown in FIG. 17 is delivered to the display devices shown in FIGS. 16A and 16B.

FIG. 19 is a view showing another example of display signal delivered to the display devices shown in FIGS. 16A and 16B.

FIGS. 20A and 20B are views respectively showing display states in the case where the display signal shown in FIG. 19 is delivered to the display devices shown in FIGS. 16A and 16B.

FIGS. 21A to 21D are views showing display states in the case where the common display signal is delivered to display devices having different resolutions from each other.

FIG. 22 is a view showing a common display signal delivered to the display devices shown in FIGS. 21A to 21D.

FIG. 23 is a view showing a series of display signals arranged in order from coarse signals in division to fine signals in division.

BEST MODE FOR CARRYING OUT THE INVENTION

§1 Fundamental Principle of this Invention

Figure 2:
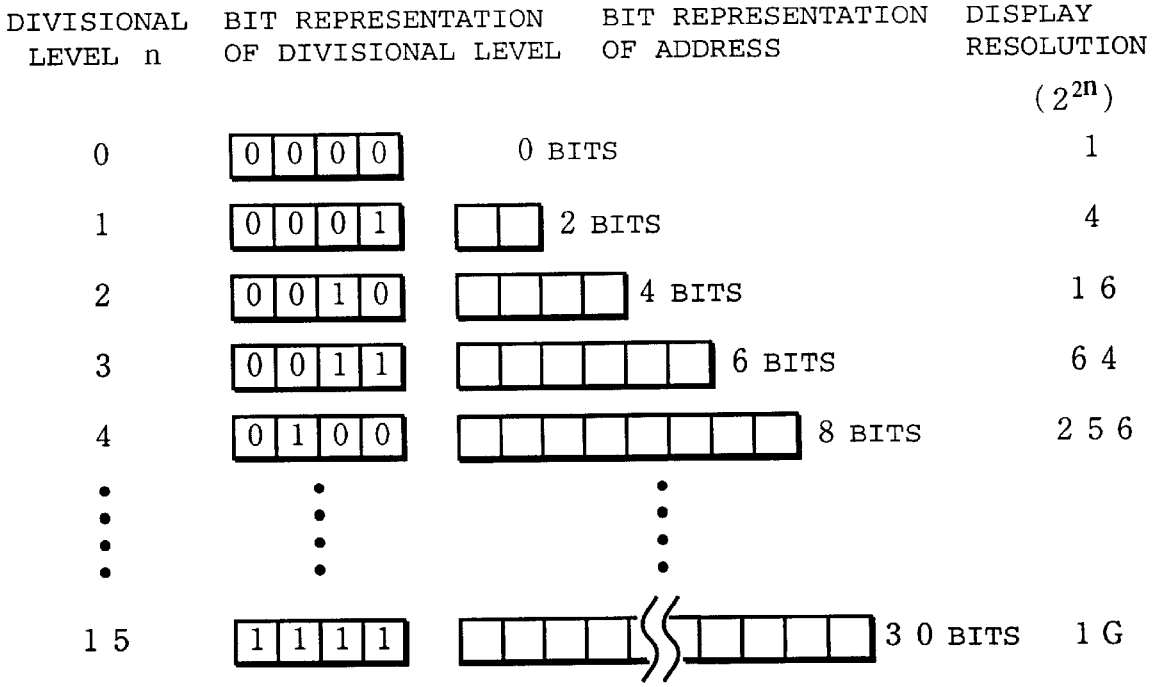
FIG. 2 is a view showing divisional levels with respect to individual divisional modes and bit representation of address.

A display device according to this invention is of a structure in which a large number of display elements are arranged in a matrix form. In this device, respective display elements constitute individual pixels. The respective display elements are elements having a function to vary display state of a pixel driven by electrical power. In general electric bulletin boards, etc., electric bulbs or light emitting diodes are used as display elements. In advertisement display panels, etc., panel type display elements are also used. The panel type display element itself does not have a function to emit light, but it has plural display surfaces. In practise, only either one surface is presented. Ordinarily, a display surface to be presented can be selected by utilizing a rotational mechanism such as motor, etc.

When a large number of display elements, which have a function to vary a display state as a pixel driven by electric power, are arranged in a matrix form, two-dimensional pixel arrangement is constituted. Accordingly, if display states are respectively instructed for every pixel, display of characters or picture images can be carried out as a whole. In such a display device, in order to improve the display resolution, it is necessary to increase the number of pixels. However, since instructions of display state are given for individual pixels in conventional devices, the number of instructions to be given should be increased with increasing the number of pixels. As a result, the efficient display operation could not be attained.

Assuming that electric bulbs are arranged in a form of matrix of 256 by 256 in length and breadth directions to constitute an electric bulletin board with the two-dimensional pixel arrangement consisting of 65,536 electric bulbs in total. The most popular conventional method to control display of such an electric bulletin board is a method in which independent electric power supply passages are respectively wired in advance with respect to all the electric bulbs from a control unit to carry out ON/OFF control of electric power for every respective wirings. With such a method, however, according as the number of electric bulbs is increased, the number of wirings is also increased. As a result, assembling of the device and maintenance thereof become difficult. In view of the above, there is disclosed, in the above-described PCT/JP95/00901 specification, the novel technique in which addresses are given to individual electric bulbs and a controller capable of recognizing these addresses is provided and an address designated display signal is delivered through a common signal transmission passage. When such a technique is employed, it is sufficient to connect a large number of electric bulbs to the common signal transmission passage. Accordingly, wiring is very simplified. In addition, when display signals in which addresses of specific electric bulbs are designated are delivered to this common signal transmission passage, it becomes possible to independently control individual electric bulbs. However, even in the case where such a novel technique is used, it is necessary to respectively deliver display signals for every respective electric bulbs to carry out control. Namely, in the above-described example, it is required to deliver independent display signals to respective 65,536 electric bulbs to control. For this reason, it takes much time for replacing a picture image being displayed with a new one. Particularly, when a moving picture is displayed, there is a problem for following up an proper display operation.

The fundamental principle of this invention resides in that the two-dimensional pixel arrangement is divided into plural blocks and display signals are delivered to the respective blocks to collectively control the display states of the entirety of display elements belonging to respective blocks. FIG. 1 is a view showing four kinds of divisional modes for dividing the two-dimensional pixel arrangement into plural blocks and addresses defined with respect to respective blocks obtained in the individual divisional modes. Respective divisional modes are indicated by divisional level n.

The first mode shown at the first row of FIG. 1 is a divisional mode indicated by the divisional level n=0. From a practical point of view, none division is carried out. Namely, the entire screen of the display device belongs to the same block, and all of 65,536 electric bulbs belong to this same block. On the other hand, the second mode shown at the second row of FIG. 1 is a divisional mode indicated by the divisional level n=1, wherein respective two divisions in length and breadth directions, i.e., four divisions in total are carried out. Thus, the entire screen of the display device is divided into four blocks of block a, b, c and d. Respective blocks a to d are all comprised of 16,384 electric bulbs arranged in a form of matrix of 128 by 128 in length and breadth directions. Moreover, the third mode shown at the third row of FIG. 1 is a divisional mode indicated by-the divisional level n=2, wherein respective four divisions in length and breadth directions, i.e., 16 divisions in total are carried out. The sixteen blocks are all comprised of 4,096 electric bulbs arranged in a form of matrix of 64 by 64 in length and breadth directions. Further, the fourth mode shown at the fourth row of FIG. 1 is a divisional mode indicated by the divisional level n=3, wherein respective eight divisions in length and breadth directions, i.e., 64 divisions in total are carried out. The sixty four blocks are all comprised of 1,024 electric bulbs arranged in a form of matrix of 32 by 32 in length and breadth directions.

While up to only the divisional level n=3 is illustrated in FIG. 1 mentioned above, if the number of divisions is similarly increased, respective 256 divisions are ultimately carried out in length and breadth directions in a divisional mode indicated by the divisional level n=8. Thus, 65,536 blocks are formed. In other words, in the divisional mode of the divisional level n=8, a block corresponds to a pixel (an electric bulb). It is to be noted that, in this specification, when the number of divisional level n becomes greater, a condition is called by "level goes up" or "level becomes high". On the contrary, when the number of divisional level n becomes smaller, a condition is called by "level goes down" or "level becomes low".

In this invention, as stated above, plural kinds of divisional modes for dividing the entire screen (two-dimensional pixel arrangement) of the display device into plural blocks are defined, and the respective divisional modes are indicated by the divisional level n which indicates fineness of division. From a viewpoint of principle, as far as plural kinds of divisional modes are defined and respective fineness of division is different from each other, any kinds of definition may be carried out. However, from a practical point of view, it is preferable to define divisional modes indicated by divisional level n as shown in the example of FIG. 1 mentioned above, where the two-dimensional pixel arrangement is divided into $2^n$ blocks respectively in length and breadth directions so that $2^{2n}$ blocks are provided thus to define N kinds of divisional modes in total with respect to n=1, 2, . . . , i, . . . N.

If plural kinds of divisional modes are defined in the above mentioned way, addresses for indicating respective blocks are defined for every individual divisional modes. In the example shown in FIG. 1, no definition of address is made with respect to the divisional level n=0, because only one block exists and address is unnecessary. However, with respect to four blocks obtained in the divisional mode indicated by the divisional level n=1, addresses consisting of 2 bits of 00, 01, 10, 11 are respectively defined as shown in FIG. 1. With respect to sixteen blocks obtained in the divisional mode indicated by the divisional level n=2, addresses consisting of 4 bits of 0000, 0001, 0010, 0011, . . . are respectively defined as shown. With respect to sixty four blocks obtained in the divisional mode indicated by the divisional level n=3, addresses consisting of 6 bits of 000000, 000001, . . . are respectively defined as shown.

Eventually, in the embodiment shown in FIG. 1 mentioned above, an address definition for respective $2^{2i}$ blocks, which are obtained in the divisional mode indicated by the divisional level n=i, are made by such a way that any one of 00, 01, 10, 11 is added to the right side of address digits of respective $2^{2(i-1)}$ blocks obtained in the divisional mode indicated by the divisional level n=(i−1) which is a lower divisional level by one. For example, addresses with respect to blocks e, f, g, h obtained in the divisional mode indicated by the divisional level n=2 are made by such a way that 00, 01, 10, 11 are respectively added to the right side of address digits "00" indicating block a (a block occupying the same position as those of blocks e, f, g and h) obtained in the divisional mode indicated by the divisional level n=1 which is a lower divisional level by one. In this case, which two bits should be added to the right side of the digits "00" is determined by a method similar to the address definition with respect to four blocks a, b, c and d. For example, since the mutual positional relationship of four blocks e, f, g and h is equivalent to the mutual positional relationship of four blocks a, b, c and d, the low order 2 bits of address of the block e is caused to be "00" which is the same as address of the block a, the low order 2 bits of address of the block f is caused to be "01" which is the same as address of the block b, the low order 2 bits of address of the block g is caused to be "10" which is the same as address of the block c, and the low order 2 bits of address of the block h is caused to be "11" which is the same as address of the block d.

Of course, it is not necessarily required to carry out such an address definition as described above in implementing this invention. However, in order to lessen an operation load and allow the display device to carry out efficient display operation, it. is preferable to carry out the address definition as described-above. If the above described address definition is carried out, when the low order 2 bits are deleted from an address of a specific block, an address of the block which is located in the same position and whose divisional level is lower by one can be obtained. Moreover, the number of bits required for such address definition is indicated by 2n bits as shown in FIG. 1. In addition, the display resolution at each divisional level n (i.e., the total number of blocks obtained) is $2^{2n}$ as shown in FIG. 1.

FIG. 2 is a view showing bit representation of divisional levels and addresses with respect to the above-described individual divisional modes. In this example, the divisional level n is represented by 4 bits. Thus, it is possible to define sixteen kinds of divisional modes from n=0 up to n=15. On the other hand, the numbers of bits of addresses necessary for indicating respective blocks are different for individual divisional levels as previously described. In general, when a divisional level is caused to be increased by one, additional two bits are required for address. Accordingly, at the highest divisional level n=15, an address consisting of 30 bits is required. However, at the divisional level n=15, very fine display resolution of as far as 1 GB can be obtained.

Figure 3:
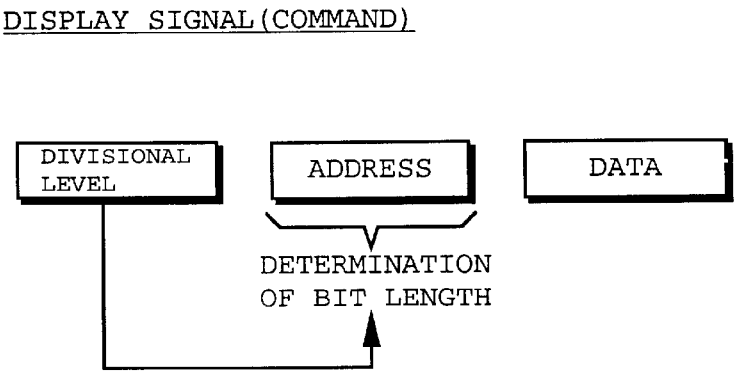
FIG. 3 is a view showing the fundamental format of display signal used for instructing display content in a display device according to this invention.

In this invention, an instruction for display contents is given by a display signal indicating a command having fundamental format as shown in FIG. 3. This format is of a structure in which a divisional level, an address and data are caused to be successive in the order recited. In this case, the bit length of the portion of address is determined on the basis of the divisional level as shown in FIG. 2. According as the divisional level becomes higher, the bit length of address becomes longer. If the divisional level is represented by 4 bits as shown in FIG. 2, it is possible to express a particular block of the divisional level n=1 by six bits in total. For example, the first 4 bits of the bit train "000101" indicate the divisional level n=1 and the remaining 2 bits indicate the address "01". Accordingly, the block b of the divisional level n=1 of FIG. 1 is specified by this bit train of 6 bits. On the other hand, data which is the last component of the format shown FIG. 3 is information indicating display state of a display element. For example, if one bit of information "0" indicating "turn OFF" or one bit of information "1" indicating "turn ON" is allocated as data, the bit train of 7 bits "0001011", which is a command consisting of combination of divisional level "0001", address "01" and data "1", indicates the instruction of "turn ON all of display elements (electric bulbs) belonging to the block b of the divisional level n=1 of FIG. 1".

In this specification, a bit train based on this format is represented by inserting slashes between respective partial bit trains such as "a bit train indicating divisional level/a bit train indicating address/a bit train indicating data" for convenience of explanation. For example, the above-described command of 7 bits is assumed to be represented in a manner of "0001/01/1" in this specification. It is a matter of course that such slashes between bit trains do not exist in fact.

If a command described by the format shown in FIG. 3 is used in this way, it is possible to freely (desirably) give instruction to an arbitrary display element. For example, a command consisting of a bit train of 5 bits expressed by "0000/(no address)/1" indicates an instruction of "turn ON all of the electric bulbs belonging to the block of the divisional level n=0 (all the electric bulbs of this display device), a command consisting of a bit train of 9 bits expressed by "0010/0011/0" indicates an instruction of "turn OFF all of the electric bulbs belonging to the block h of the divisional level n=2", and a command consisting of a bit train of 11 bits expressed by "0011/010101/1" indicates an instruction of "turn ON all of the electric bulbs belonging to the block i of the divisional level n=3". In order to execute an instruction based on commands described in such a format, as a matter of course, it is necessary to prepare a controller for recognizing addresses within a display device to turn ON or turn OFF a predetermined electric bulb. The more practical device configuration including such a controller will be described later.

Figure 4A:
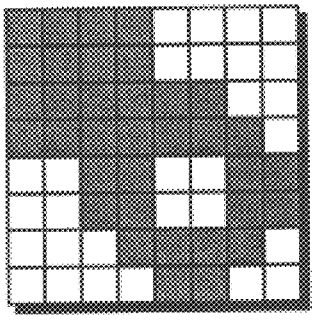
FIGS. 4A to 4D are views showing the state where the two-dimensional pixel arrangement is divided by various divisional modes and particular patterns are displayed.

Subsequently, let demonstrate how the display device can be efficiently controlled with commands of the format shown in the FIG. 3 by referring to an actual example. Let consider the display device comprised of 64 electric bulbs (pixels) in total arranged in a form of matrix of 8 rows by 8 columns as shown in FIG. 4A. Supposing that only a part of electric bulbs in which hatching is implemented in the figure are caused to be turned ON to display a predetermined pattern. In the conventional display device, it is necessary to give an instruction of either "turn ON" or "turn OFF" to individual 64 electric bulbs to obtain a display state as shown in FIG. 4A. It is a matter of course that if all the electric bulbs are caused to be once brought into the turn OFF state, it is enough to give instructions only with respect to 35 electric bulbs to be "turned ON" to obtain the display state shown in FIG. 4A. Even in such a case, 35 commands are required. For example, in the case of a device in which addresses are allocated to respective electric bulbs and a controller having a function to recognize these addresses is used to control display states of respective electric bulbs as in the device disclosed in the above-mentioned PCT/JP95/00901 specification, it is required to prepare commands including a predetermined address (indicating any one of 64 electric bulbs) and predetermined data (e.g., data "1" indicating "turn ON") with respect to 35 addresses to give 35 commands in total.

Figure 4B:
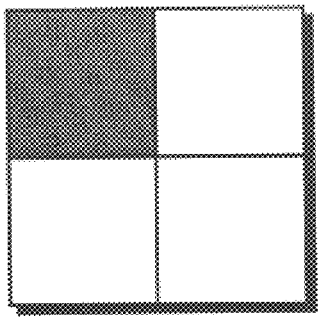
Figure 4C:
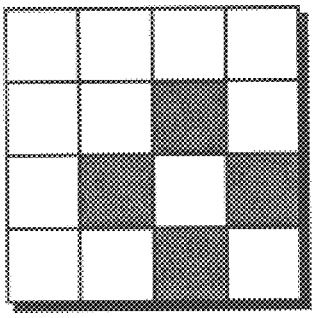
Figure 4D:
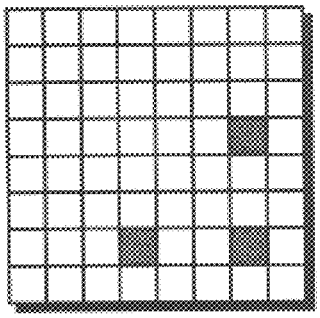

On the contrary, in this invention, it is possible to obtain a specific display state shown in FIG. 4A only by 8 commands. First, command relating to the divisional level n=1 expressed by "0001/00/1" as shown in the lower part of FIG. 4B is given. By this command, 16 electric bulbs belonging to the specific block, which is positioned at the left and upper portion of the quadrisected two-dimensional pixel arrangement portions and is hatched as shown in FIG. 4B, are turned ON at the same time. Subsequently, commands relating to the divisional level n=2 expressed by "0010/0110/1", "0010/1001/1", "0010/1101/1", "0010/1110/1" as indicated in the lower part of FIG. 4C are given. By these commands, 16 electric bulbs in total belonging to the specific 4 blocks, which are hatched as shown in FIG. 4C, of two-dimensional pixel arrangement portions divided by 16 are turned ON at the same time. Last, commands relating to the divisional level n=3 expressed by "0011/011110/1", "0011/101101/1" "0011/111100/1" as indicated in the lower part of FIG. 4D are given. By these commands, three electric bulbs in total belonging to the specific three blocks, which are hatched as shown in FIG. 4D, of the two-dimensional pixel arrangement portions divided by 64 are turned ON at the same time. In this way, 35 electric bulbs in total belonging to the blocks which are hatched in FIGS. 4B, 4C, 4D are turned ON. Thus, a specific display pattern as shown in FIG. 4A is obtained.

Figure 5A:
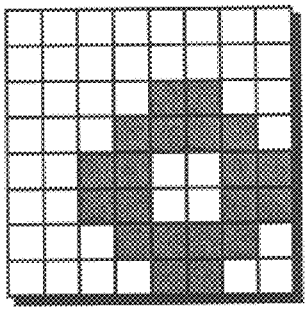
FIGS. 5A to 5F are views showing another example of the state where the two-dimensional pixel arrangement is divided by various divisional modes and particular patterns are displayed.
Figure 5B:
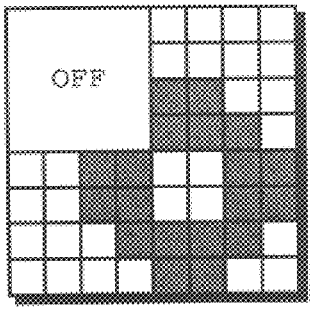
Figure 5C:
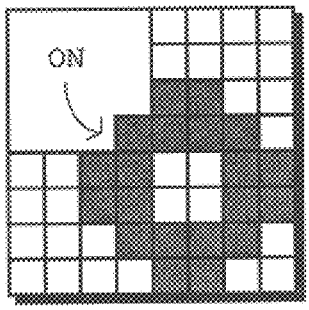

This invention is effective also in the case of carrying out rewrite operation from a certain display state to another display state. For example, in the case of rewriting the display state shown in FIG. 4A into the display state shown in FIG. 5A, the rewrite operation is completed only with the two commands by the following process. Initially, as shown in FIG. 5B, a command relating to the divisional level n=1 expressed by "0001/00/0" is given. By this command, 16 electric bulbs belonging to the block at the left and upper portion of the quadrisected two-dimensional pixel arrangement portions are turned OFF at the same time. Subsequently, as shown in FIG. 5C, a command relating to the divisional level n=2 expressed by "0011/001111/1" is given. By this command, one electric bulb which has been once placed in OFF state is brought into the ON state for a second time. Thus, the display state shown in FIG. 5A is obtained.

Figure 5D:
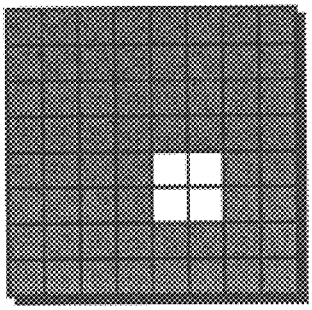
Figure 5E:
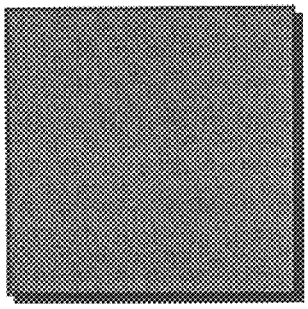
Figure 5F:
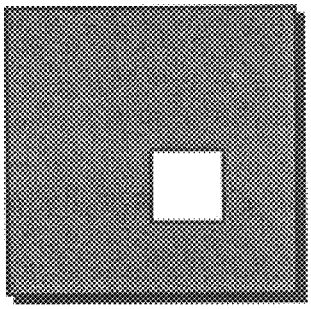

Moreover, in the case of obtaining display state shown in FIG. 5D, it is sufficient to first give a command relating to the divisional level n=0 expressed by "0000/(no address)/1" as shown in FIG. 5E to once turn ON all of the 64 electric bulbs and subsequently to give a command relating to the divisional level n=2 expressed by "0010/1100/0" as shown in FIG. 5F to turn OFF four electric bulbs.

As stated above, in the display device according to this invention, plural commands different in the divisional levels are suitably combined, thereby making it possible to efficiently give instructions. As a result, time for rewriting operation is reduced. Thus, high speed display operation can be made. It is to be noted that, in this invention, only one method for obtaining a specific display state does not necessarily exist, but plural kinds of methods ordinarily exist. Accordingly, in the case of delivering a display signal consisting of plural commands, it is preferable to determine a most efficient combination of commands on the basis of a predetermined algorithm.

Moreover, in the case where plural commands are sequentially delivered in order to obtain a specific display state, the order for delivering commands may be any order from a theoretical point of view. However, from a practical point of view, since a predetermined processing time is required for executing turn ON or turn OFF process based on commands, it is to be noted that there is a time difference between a starting point for executing a first command and a starting point for executing a second command which is given later than the first command. In the case where such a time difference is sufficiently small as compared to the sense level of the human being, even if commands are given in any order, there is no problem. However, in the case where a time difference is close to the sense level of the human being, it is preferable to first give a command of low divisional level thereafter to give a command of high divisional level. For example, in the case of obtaining the display state shown in FIG. 4A, it is preferable to give commands in order of FIGS. 4B, 4C, 4D. If a broader area is first presented and a fine portion is subsequently presented in a manner as stated above, the fact that a certain time difference takes place in display becomes difficult to be sensed.

As shown in FIG. 2, in accordance with the format of this invention, when a divisional level n becomes greater, a bit length required for address becomes longer. For this reason, in the examples which have been described above, total bit lengths of individual commands are different in dependency upon the divisional level. However, from a viewpoint of practical use, it is convenient to handle a command having a fixed length. In order to fix the length of commands, it is desirable that, in the format shown in FIG. 3, a bit length of the divisional level is caused to be fixed and a sum of a bit length of address and a bit length of data is caused to be fixed.

Figure 6:
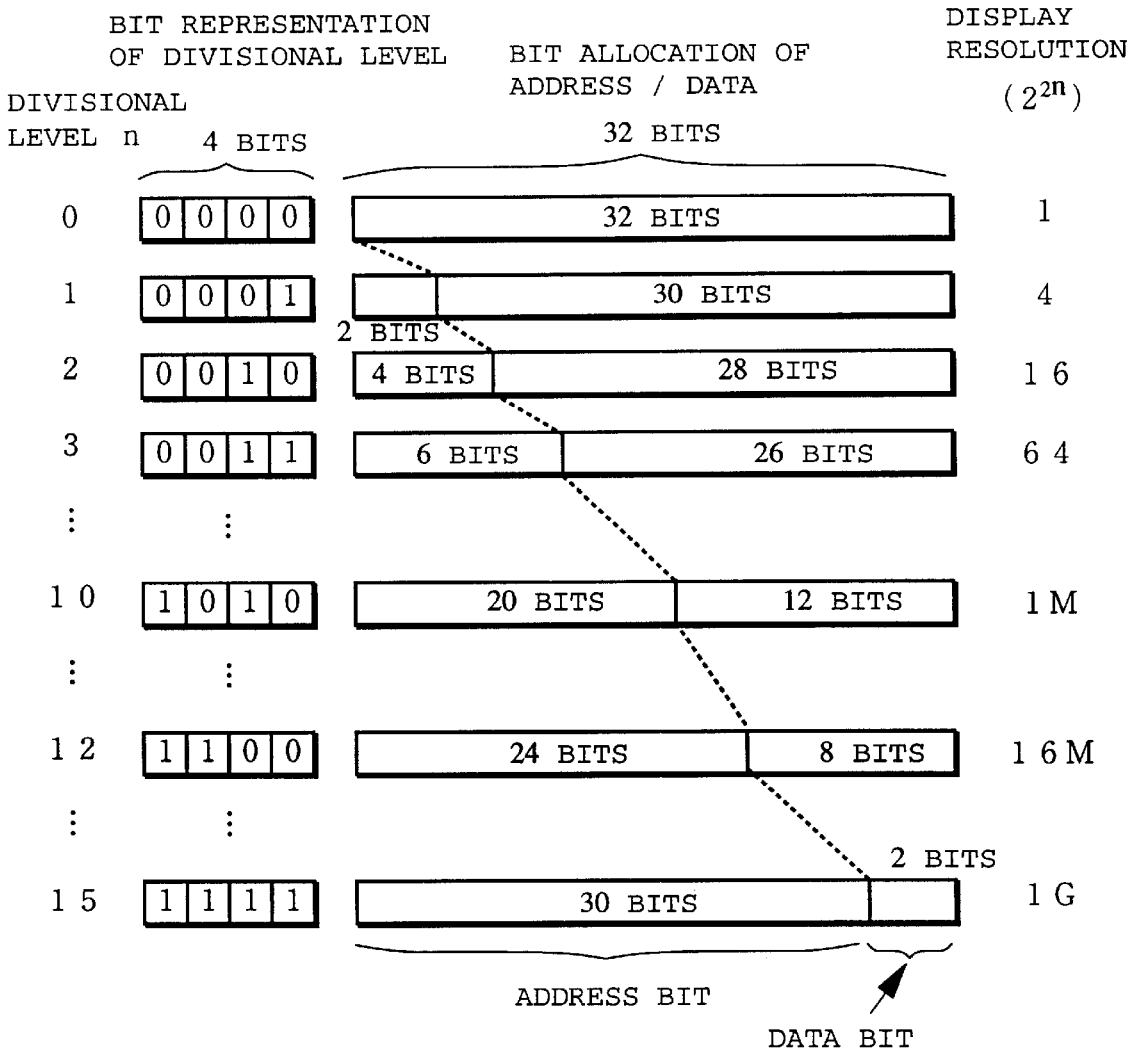
FIG. 6 is a view showing bit allocation of address/data with respect to individual divisional modes in the case where sum of address length and data length is fixed to 32 bits.

FIG. 6 is a view showing a bit allocation of address/data with respect to individual divisional modes in the case where a bit length of the divisional level is fixed to 4 bits and a sum of address length and data length is fixed to 32 bits. The divisional level represented by 4 bits is the level of 16 stages from n=0 to 15. The display resolution in the case of n=15 reaches as far as 1G. This is sufficient from a viewpoint of practical use. On the other hand, since address/data have 32 bits in total, in the case where the divisional level n is low, it is possible to ensure a sufficient data length. However, when the divisional level n becomes higher, a sufficient data length cannot be ensured. For example, in the example of FIG. 6, in the case of the divisional level n=0, a sufficient bit length of 32 bits is ensured as data bits, though in the case of the divisional level n=15, only 2 bits are ensured as data bits.

However, even if the bit allocation as shown in FIG. 6 is carried out, no problem takes place from a viewpoint of practical use. In other words, the bit allocation method of "allowing a sum of address length and data length to be fixed" is in conformity with the pattern recognition characteristic by the visual sense of the human being. First of all, the data length "32 bits" ensured at the divisional level 0 is sufficient length even in the case of carrying out display of color picture image. Let suppose that each pixel is not comprised of an electric bulb, but is composed of three light emitting diodes for presenting three primary colors of RGB, and respective light emitting diodes have a function to emit light by luminance of 256 stages. In this case, a display of the so-called full color (16,700,000 colors) can be made by using three primary colors of RGB. However, since it is sufficient for giving an instruction of luminance made of 8 bit data for respective primary colors, it is sufficient to provide a data of 24 bits to the respective light emitting diodes. The above-described data length of "32 bits" is sufficient also in carrying out such a full color display. On the other hand, with the data length "2 bits" ensured at the divisional level 15, only 4 display states can be instructed. However, the area displayed by using this divisional level 15 is a very small area as compared to the entire display screen. Accordingly, even if only 4 display states can be selected, disagreement of feeling does not take place in carrying out pattern recognition by the visual sense of the human being.

Figure 7:
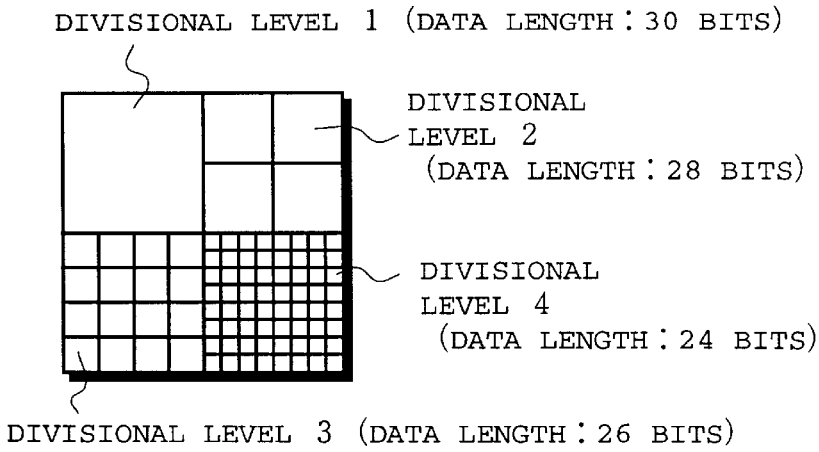
FIG. 7 is a view showing an example of display screen in which various divisional modes are mixed.

FIG. 7 is a view showing an example of a display picture on screen in which various divisional modes are mixed. In this display picture on screen, the area at the left and upper portion is displayed at the divisional level 1 (data length: 30 bits), the area at the right and upper portion is displayed at the divisional level 2 (data length: 28 bits), the area at the left and lower portion is displayed at the divisional level 3 (data length: 26 bits), and the area at the right and lower portion is displayed at the divisional level 4 (data length: 24 bits). In this case, it is seen that according as the area of the block becomes broader, a data length allocated thereto becomes longer so that more fine color representation can be made. In a manner opposite to the above, according as the area of the block becomes smaller, the data length allocated thereto becomes shorter so that color representation becomes coarse. This characteristic is in correspondence with the pattern recognition by the visual sense of the human being. Namely, since the eye of the human being is sensitive to color representation with respect to the broad area but is dull with respect to the small area, even if representation by short data length is carried out with respect to the very small area having high divisional level, disagreement of feeling does not take place.

In this example, commands of respective divisional levels shown in FIG. 6 all consist of a bit train of 36 bits in total. Initially, the divisional level n is recognized by the first 4 bits, and then the following 2n bits are recognized as bits indicating address. Finally the remaining bits are recognized as bits indicating data. Moreover, in this example, only 4 bits are used for indicating the divisional level n. However, the information of the divisional level is very important, because if the divisional level n is erroneously recognized, the subsequent information of address and data could not properly recognized. Therefore, from a viewpoint of practical use, it is preferable to add an error correction code thereto, or to repeat twice the same information so that the information has redundancy. Especially, with respect to the command of the divisional level n=0 and other commands of lower divisional levels, it is preferable to provide redundancy by various methods, because these commands influence the entire screen or the large area portion of the entire screen.

§2 Configuration of Practical Display Device

Figure 8:
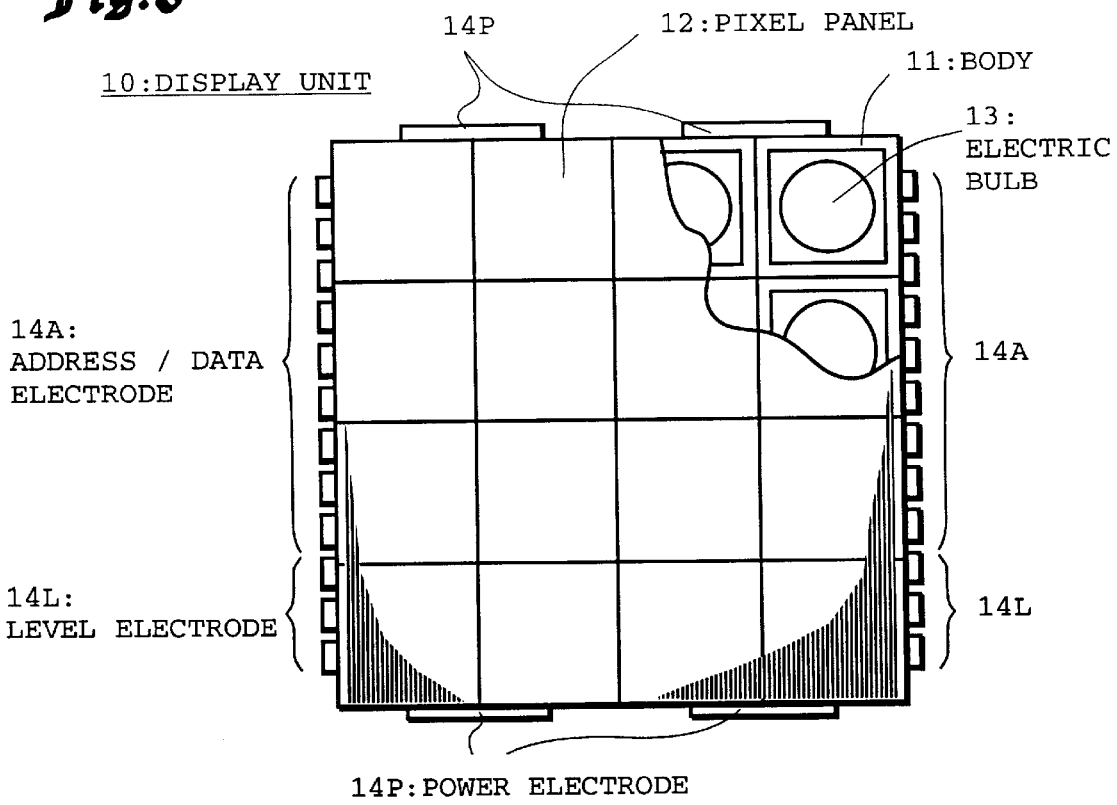
FIG. 8 is a top view of display unit 10 constituting a display device according to an embodiment of this invention.

An embodiment of a practical display device in which this invention is applied to the electric-bulletin board using electric bulbs will now be described. Initially, plural display units 10 having a structure as shown in the top view of FIG. 8 are prepared (a part of the structure in FIG. 8 is indicated by cutting). The display unit 10 is a member of which top surface is regular square, and is of a structure in which a pixel panel 12 is attached on the upper surface of a body 11. The inner portion of the body 11 is divided into 16 divisions in total arranged in a form of a matrix of 4 by 4, and divisional lines corresponding to these divisions are also depicted on the pixel panel 12. In this embodiment, respective divisions correspond to respective pixels. Within the respective divisions in the body 11, electric bulbs 13 are respectively disposed. By controlling energizing to these electric bulbs 13, it is possible to switch ON (light emitting) state or OFF (non-light emitting) state. Accordingly, when the display unit 10 is viewed from the upper surface, light emitting state or non-light emitting state of the respective portions of the individual pixel panel 12 divided into 16 divisions are observed.

One of characterized features of this display unit 10 resides in that various electrodes are formed on the side surface. Namely, as shown in the top view of FIG. 8, nine address/data electrodes 14A and three level electrodes 14L are respectively provided on the left and right side surfaces, and two electric power source electrodes 14P are respectively provided on the front and the back face. In the top view of FIG. 8, the nine address/data electrodes 14A on the left side surface and the nine address/data electrodes 14A on the right side surface are respectively conductive within the body 11. Similarly, the three level electrodes 14L on the left side surface and the three level electrodes 14L on the right side surface are respectively conductive within the body 11. Moreover, the two power electrodes 14P on the front face and two power electrodes 14P on the back face are similarly respectively conductive within the body 11. In addition, although not shown in the figure, write electrode 14W is further provided on the bottom surface of the display unit 10. This write electrode 14W is an electrode used for applying a predetermined write voltage when address information with respect to a non-volatile memory included within this display unit 10 is stored.

Figure 9:
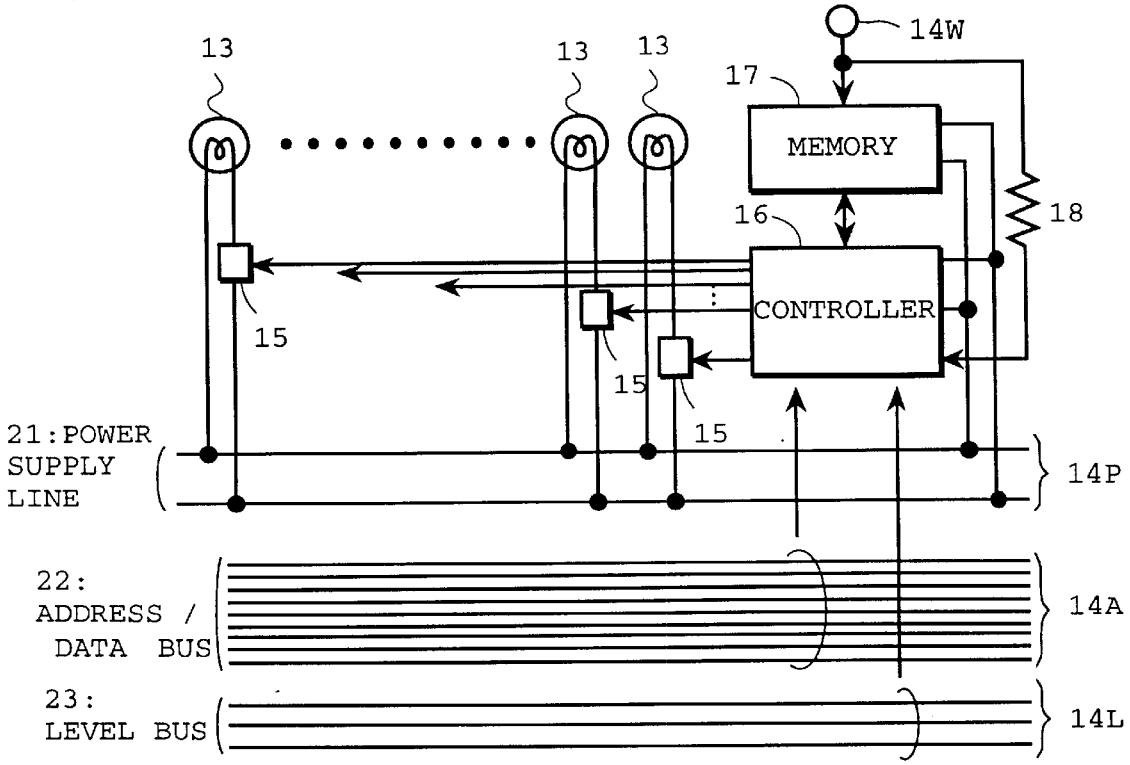
FIG. 9 is an internal circuit diagram of the display unit 10 shown in FIG. 8.

FIG. 9 is a wiring diagram of the inside of this display unit 10. As shown in this wiring diagram, within the display unit, two power supply lines 21 connected to the power electrodes 14P, nine lines of address/data bus 22 connected to the address/data electrodes 14A, and three lines of level bus 23 connected to the level electrodes 14L are drawn. Moreover, as described above, the inside of the display unit 10 is divided into 16 pixels, and respective pixels are constituted by respective electric bulbs 13 (only a part of 16 electric bulbs is shown for convenience in FIG. 9). The respective electric bulbs 13 are all connected to the power supply lines 21, wherein their one ends are respectively connected thereto through control elements 15 (e.g., transistors or relays). The operations of the respective control elements 15 are controlled by a controller 16. The controller 16 is supplied with address A and data D from the address/data bus 22, and level L from the level bus 23. Thus, the controller 16 controls individual control elements 15 on the basis of level L, address A and data D which are delivered thereto by referring an address which is stored in a non-volatile memory 17. Write voltage can be applied to the non-volatile memory 17 from the write electrode 14W, thus making it possible to carry out a processing to write a predetermined address from the controller 16 into the non-volatile memory 17. The write voltage applied to the write electrode 14W is dropped by a resistance element 18, and is applied also to the control terminal of the controller 16. The controller 16 is operative so that when voltage is applied to this control terminal, it executes predetermined write processing with respect to the non-volatile memory 17. In this example, an electric power is supplied from the power supply lines 21 to the controller 16 and the non-volatile memory 17. Thus, voltage necessary for operation is ensured.

Figure 10:
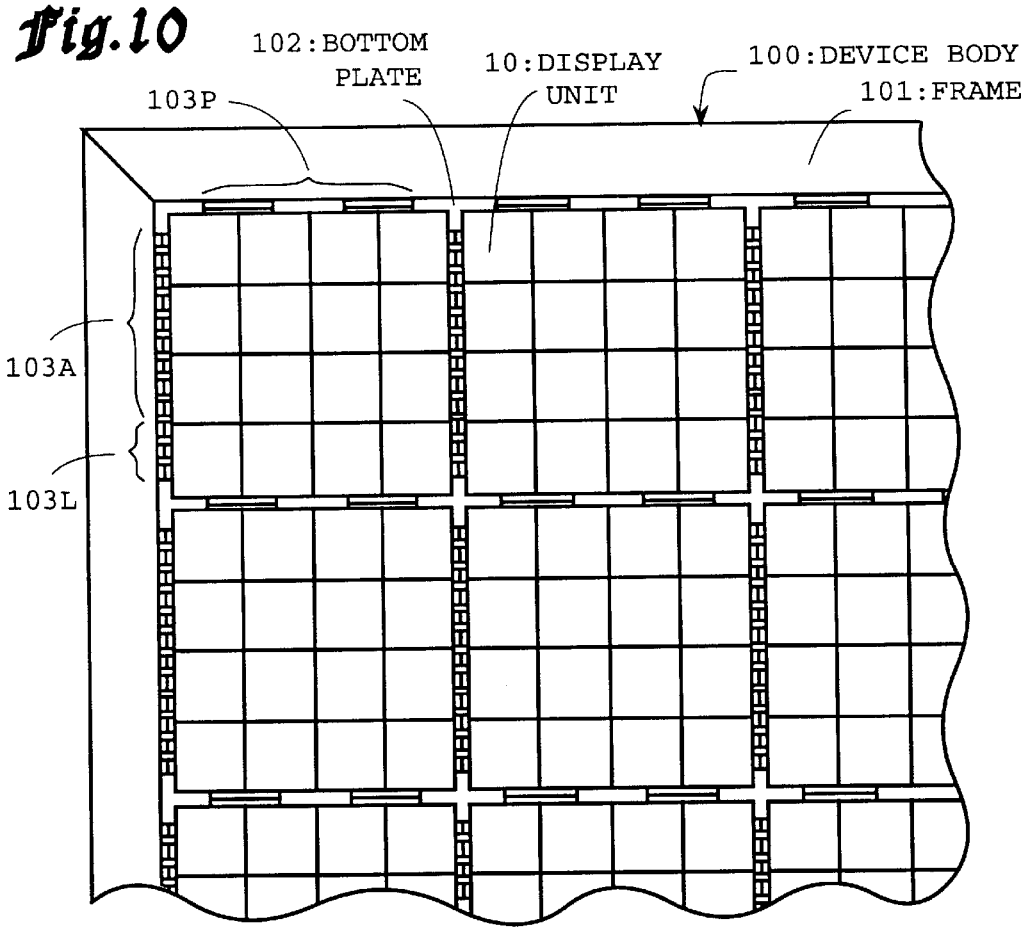
FIG. 10 is a partial top view showing the state where plural display units 10 shown in FIG. 8 are prepared to thereby constitute device body 100.
Figure 11:
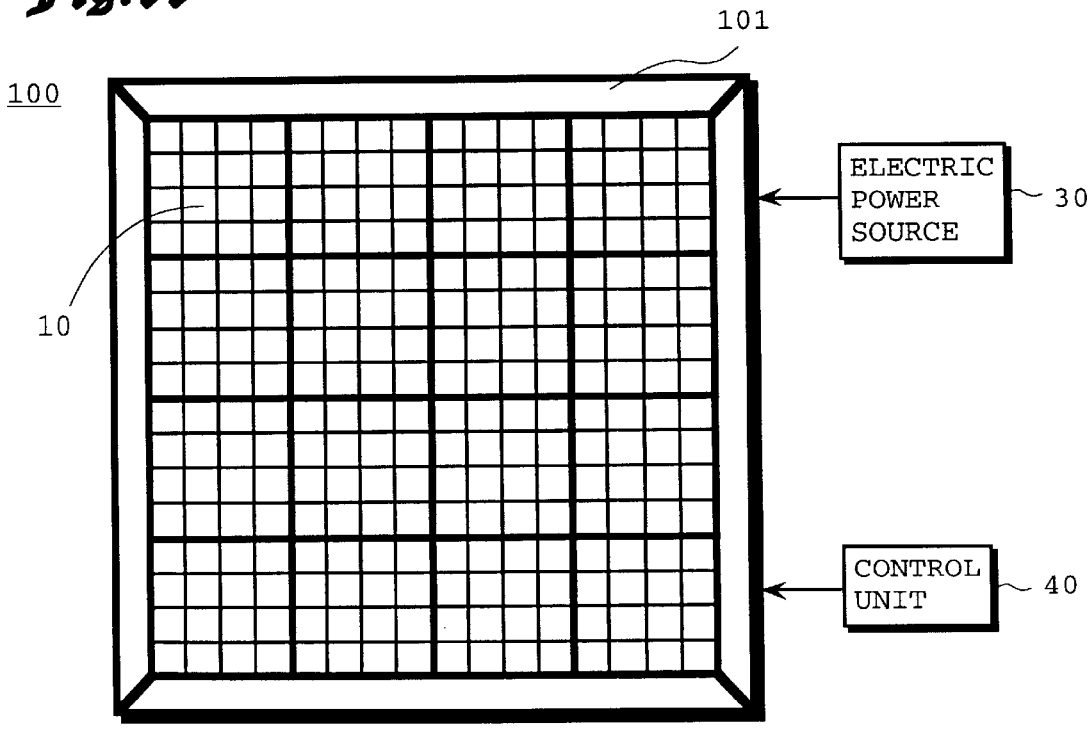
FIG. 11 is a view showing the entirety of display device constituted with the device body 100 shown in FIG. 10.

FIG. 10 is a partial top view showing the state where plural number of display units 10 as described above are prepared so as to constitute a device body 100. The casing portion of the device body 100 is constituted by a frame 101 and a bottom plate 102. The frame 101 is like a picture frame and the bottom plate 102 is secured on the bottom surface of the frame 101. When the display units 10 are fitted into the inside portion of the frame 101, the display units 10 are placed in the state where their bottom surfaces are supported by the bottom plate 102. Thus, the upper surfaces of the display units 10 and the upper surface of the frame 101 are caused to be substantially flush with each other. FIG. 11 shows the entire state where 16 (4 by 4) display units 10 are fitted into the casing portion in this way to constitute the device body 100. By adding an electric power source 30 and a control unit 40 to this device body 100, the entirety of the display device according to this invention is constituted. The device body 100 forms a device of the so-called hanging-on-the-wall-type in which 16 tiles (display units 10) are fitted within the frame. It is to be noted that while the electric power source 30 and the control unit 40 are illustrated as separate blocks in the figure, it is preferable from a practical point of view to include the power supply 30 and the control unit 40 as well within the device body 100 so that the entirety of the device is caused to be of an integral structure.

As it has been explained with reference to FIG. 8, 16 (4 by 4) pixels are defined on the pixel panel 12 of the respective display unit 10, and the electric bulbs 13 are embedded at the respective pixel positions. Accordingly, 16×16=256 pixels are defined on the display screen of the display device shown in FIG. 11. Thus, respective pixels emit light with a predetermined luminance based on light emitting operation of the electric bulbs 13.

In the above described embodiment, as shown in FIG. 10, it is seen that the electrodes formed on the corresponding positions are physically in contact with each other because the display units 10 are accommodated in a manner adjacent to each other. In addition, also on the inside portion of the frame 101, similarly to the display unit 10, the address/data electrodes 103A, the level electrodes 103L and the power electrodes 103P are provided and these electrodes are respectively in contact with the address/data electrodes 14A, the level electrodes 14L and the power electrodes 14P of the display unit 10. Accordingly, in FIG. 10, nine lines of address/data bus 22 and three lines of level bus 23 are drawn through the four display units 10 disposed in a lateral direction, and two power supply lines 21 are drawn through the four display units 10 disposed in a longitudinal direction. In this configuration, if corresponding electrode pins of the address/data electrodes 103A, the level electrodes 103L and the power electrodes 103P provided at plural portions of the frame 101 are electrically connected, it is possible to form a common address/data bus 22, a common level bus 23 and a common power supply lines 21 with respect to sixteen display units 10.

Subsequently, the operation of this display device will be described. In the device of this embodiment, as shown in, FIG. 11, 256 pixels in total are provided, wherein each pixel comprises an electric bulb 13 and it is possible to respectively control the light emitting states of these electric bulbs 13. In this embodiment, five kinds of divisional modes of n=0 to 4 are defined as the divisional levels. At the divisional level 0, it is possible to collectively designate the entirety of 256 pixels shown in FIG. 11. At the divisional level 4, it is possible to independently designate these 256 pixels one by one. The feature of this invention resides in implementation of display control by commands consisting of combination of divisional level, address and data. The control unit 40 has a function to generate such commands to deliver them to the device body 100 as display signals.

Since five kinds of divisional levels of n=0 to 4 are prepared as the divisional level in this embodiment as described above, three bits are required for representing all the divisional levels. The three lines of level bus 23 serve to carry out transmission of the divisional level information of three bits. On the other hand, the nine lines of address/data bus 22 are assigned for carrying out transmission of address information and data information. In this embodiment, such an assignment changes in dependency upon the divisional level. Namely, when the divisional level is assumed to be n, the high order of 2n lines among the nine lines of address/data bus 22 are allocated to bits indicating address, and the remaining lines are allocated to bits indicating data. For example, in the case of the divisional level n=0, there is no bit allocated to the address, and all the 9 bits are therefore allocated to data. By this data of 9 bits, it becomes possible to designate 512 steps of luminance with respect to electric bulbs 13. In the case of the divisional level n=1, the high order 2 bits are allocated to address and the remaining low order 7 bits are allocated to data. By this data of 7 bits, it is possible to designate 128 steps of luminance. However, in the case of the highest divisional level n=4, the high order 8 bits are allocated to address and only the low order 1 bit is allocated to data. In this case, only the binary control of ON or OFF can be carried out with respect to the electric bulbs 13.

The individual light emitting controls with respect to the electric bulbs 13 are carried out by the controller 16 shown in the circuit diagram of FIG. 9. The controller 16 is provided within the every respective display unit 10, and serves to deliver predetermined control signals to the control elements 15 while making reference to addresses stored in the memory 17. In the memory 17, addresses indicating positions of the display units 10 are written in advance. Since 16 display units are arranged in a form of matrix of 4 rows by 4 columns in this embodiment, addresses of 4 bits as indicated at the row of n=2 of FIG. 1 are written in advance in the memories 17 within the individual display units. For example, an address expressed by "0011" is written into the memory 17 within the display unit 10 arranged at a position indicated by the second row and the second column similarly to the block h shown in FIG. 1.

When a predetermined display signal (a command based on the previously described format) is given to the address/data bus 22 and the level bus 23, the controller 16 first recognizes the divisional level n on the basis of bits of the level bus 23. Subsequently, the controller 16 recognizes, as an address, the high order 2n bits on the address/data bus 22 to judge whether or not the recognized address is an address related to the corresponding controller 16. In more practical sense, in the case of the divisional level n=0, the controller 16 unconditionally recognizes that an address related to the corresponding controller is designated. In the case of the divisional level n=1, the controller 16 compares the given address of 2 bits with the high order 2 bits of the address of 4 bits written in the memory 17 and it recognizes that an address related thereto is designated if both the addresses to have been compared are in correspondence with each other. In the case of the divisional level n≧2, the controller 16 compares the high order 4 bits of the bit train constituting the given address with the address of 4 bits written in the memory 17 and it recognizes that an address related thereto is designated if both the addresses to have been compared are in correspondence with each other. In the case where an address related to the corresponding controller 16 is not designated, the controller 16 does not carry out any processing with respect to that command.

In the case where an address related to a corresponding controller is designated, the corresponding controller 16 recognizes which pixel is designated by that address. In more practical sense, in the case of the divisional level n≦2, all of the 16 pixels are designated. In the case of the divisional level n=3, when the low order 2 bits of address is "00", 4 pixels at the left and upper portion are designated; when that low order 2 bits are "01", 4 pixels at the right and upper portion are designated; when that low order 2 bits are "10", 4 pixels at the left and lower portion are designated; and when that low order 2 bits are "11", 4 pixels at the right and lower portion are designated. Moreover, in the case of the divisional level n=4, the controller 16 recognizes, as a designated pixel, a specific one pixel on the basis of the low order 4 bits of address (e.g., it is sufficient to recognize a specific one pixel on the basis of address definition similar to the address definition indicated at the row of n=2 of FIG. 1).

When the designated pixel is recognized in this way, the controller 16 carries out a processing to vary display state of the designated pixel on the basis of data given as the remaining bits of the address/data bus 22. Namely, the controller 16 carries out a processing to vary luminance of the electric bulb 13 corresponding to the designated pixel on the basis of data. In more practical sense, the controller 16 provides, with respect to a specific control element 15, a control signal to deliver supply current with a quantity corresponding to the data to the electric bulb 13. In the case where the data is 1 bit, a control signal just indicates ON or OFF state. In the case where the data is 2 bits, a control signal can designate any one of four kinds of current quantities (e.g., 0%, 25%, 50%, 100%). Generally, in the case where the data is k bits, a control signal can designate any one of 2 k kinds of current quantities.

Figures 12, 13:
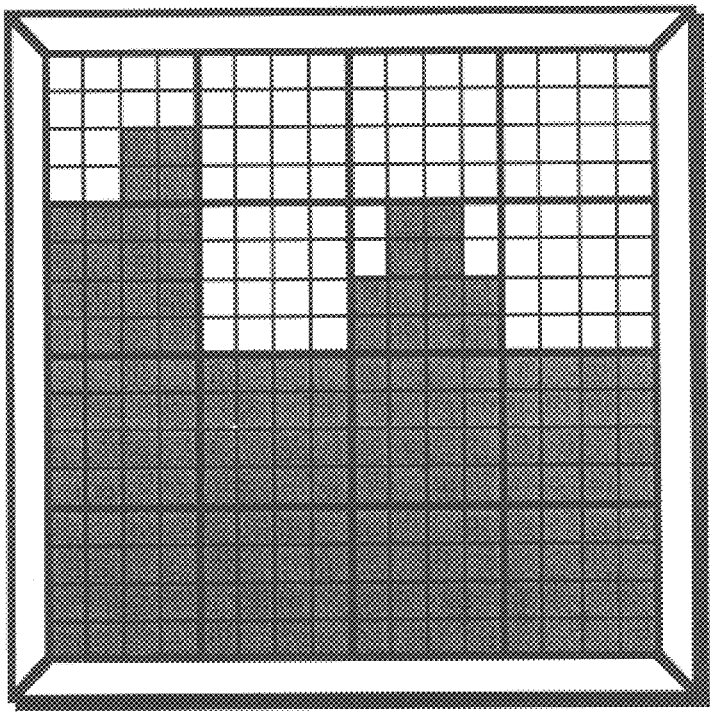
FIG. 12 is a view showing an example of the state where a picture image is displayed on the display device shown in FIG. 11.
FIG. 13 is a view showing an example of display signal delivered for obtaining the picture image shown in FIG. 12.

FIG. 12 is a view showing an example of the state where a picture image is displayed on the screen of this display device. In this example, respective pixels take only binary state of light-emitting or non-light emitting (ON/OFF of the electric bulb), wherein the pixels in which hatching is implemented in the figure indicate the pixels in the light emitting state and pixels except for the above indicate pixels in non-light emitting state. In order to provide a display having only the binary state of light emitting or non-light emitting, data is only required to have 1 bit.

FIG. 13 shows a display signal to be delivered to the device in order to obtain the display state shown in FIG. 12 from the initial state of non-light emitting. This display signal consists of 10 commands of the command No. 1 to the command No. 10. Respective commands consist of divisional level of 3 bits and address/data of 9 bits. The former is delivered from the control unit 40 through the three lines of level bus 23 being as the transmission passage and the latter is delivered from the control unit 40 through the nine lines of address/data bus 22 being as the transmission passage. In this example, the command No. 1 and No. 2 are commands of the divisional level n=1, wherein the high order 2 bits of address/data indicate an address and the low order 7 bits indicate a data. Moreover, the command No. 3 is a command of the divisional level n=2, wherein the high order 4 bits of address/data indicate an address and the low order 5 bits indicate a data. The commands No. 4 to No. 6 are commands of the divisional level n=3, wherein the high order 6 bits of address/data indicate an address and the low order 3 bits indicate a data. In addition, the commands No. 7 to No. 10 are commands of the divisional level n=4, wherein the high order 8 bits of address/data indicate an address and the low order 1 bit indicate a data. It is to be noted that since respective pixels take only binary state of light-emitting or non-light emitting, only one bit of the least significant bit (LSB) is a meaningful data bit indicating light emitting state or non-light emitting state in actuality in regard to the data.

Figures 14, 15:
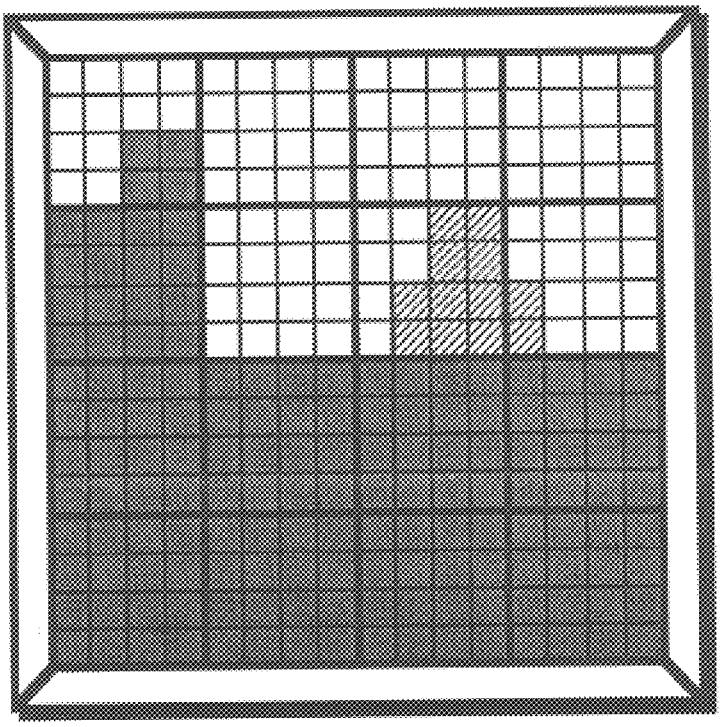
FIG. 14 is a view showing another example of the state in which a picture image is displayed on the display device shown in FIG. 11.
FIG. 15 is a view showing an example of display signal to change a picture image shown in FIG. 12 into a picture image shown in FIG. 14.

FIG. 14 is a view showing the state where a picture image shown in FIG. 12 is changed, wherein the changed portion is indicated with different hatching. FIG. 15 shows a display signal to be delivered to the device which is required for producing such a change. This display signal consists of seven commands of the command No. 1 to No. 7. The command No. 1 is a command of the divisional level n=2, wherein the high order 4 bits of address/data indicate an address and the low order 5 bits indicate a data. It is to be noted that only the least significant bit (LSB) "0" is meaningful data bit in substance, and all the pixels belonging to the block indicated by the address "0110", are once placed in a non-light emitting state by execution of this command No. 1. The subsequent commands No. 2 and No. 3 are commands of the divisional level n=3, wherein the high order 6 bits of address/data indicate an address. The commands No. 4 to No. 7 are commands of the divisional level n=4, wherein the high order 8 bits of address/data indicate an address. Also in these commands No. 2 to No. 7, the meaningful data bit is the least significant bit (LSB) "1". By execution of these commands, specific pixels are placed in a light emitting state. Thus, the display state shown in FIG. 14 is obtained.

As stated above, in this invention, in order to obtain the display state of FIG. 14 from the display state of FIG. 12, it is sufficient to give commands only with respect to the portion where the display state is changed. This is very efficient as compared to the conventional technique for scanning the entirety of the display screen to give predetermined instructions with respect to all the pixels.

It is to be noted that while the respective pixels are constituted by the respective electric bulbs in the above-described embodiment, if the respective pixels are constituted with three light emitting diodes which respectively present three primary colors of RGB, it becomes possible to display a color image. In addition, in the above-described embodiment, the address/data bus 22 and the level bus 23 are used to deliver commands as parallel signals. However, those commands may be delivered on a single transmission line as a serial signal. In this case, it is sufficient to determine, in advance, an order of bit trains serially transmitted in a manner of a divisional level, an address and a data as in the case of the format shown in FIG. 3.

§3 Application to Plural Display Devices Having Different Resolutions

The first merit of the display device according to this invention resides in that since it is unnecessary to instruct display states for individual pixels as previously described, display instructions can be efficiently given to the device so that a rewrite processing of a picture on the screen can be carried out at a high speed. In addition to this first merit, the present invention could provide the second merit. That is, according to the present invention, it becomes possible to drive plural display devices having different resolutions by using the same display signal. This second merit of this invention will be described below.

It is now assumed that a display device 210 as shown in FIG. 16A and a display device as shown in FIG. 16B are prepared. The display device 210 is comprised of sixteen pixels (e.g., electric bulbs) in total arranged in a form of a matrix of 4 rows by 4 columns, and the display device 220 is comprised of four pixels (electric bulbs) in total arranged in a form of a matrix of 2 rows by 2 columns. As stated above, both the display devices have different resolutions. Accordingly, address of four bits as shown is required for specifying a particular pixel in the display device 210, whereas it is sufficient for providing address of two bits as shown to specify a particular pixel in the display device 220.

Even in the case of two kinds of display devices having different resolutions as described above, they can be driven by the same display signal if the present invention is applied thereto. For example, let consider the case where a common display signal as shown in FIG. 17 is applied to both the display devices 210 and 220. This display signal consists of commands No. 1 and No. 2, and both the commands are commands of the divisional level n=1. The command No. 1 is a command for emitting (turning ON) the pixel (electric bulb) indicated by the address "00", and the command No. 2 is a command for emitting the pixel indicated by the address "11". By executing these commands, the display device 210 is placed in a display state as shown in FIG. 18A and the display device 220 is placed in a display state as shown in FIG. 18B. While the resolutions are different in both the display devices, patterns displayed are exactly the same.

In short, a display signal (command) of the format shown in FIG. 3 does not indicate a display state with respect to a specific hardware, but it indicates blocks formed by a specific divisional mode in a view of software. Namely, it can be said that the above-mentioned display signal is a general purpose display signal applied commonly to various hardwares. For example, the command No. 1 shown in FIG. 17 indicates an instruction "to divide the screen into four blocks and turn the pixels on belonging to the block positioned at the left and upper portion". This command can be applied commonly with respect to display devices having any resolution. Accordingly, in the display device shown in FIG. 11, it is sufficient that the control unit 40 delivers a display signal without taking the resolution of the device body 100 into consideration in any sense. In other words, even if the device body 100 is exchanged into a hardware having higher resolution, or even if it is exchanged into a hardware having lower resolution, it is sufficient that the control unit 40 delivers entirely the same display signal.

Let now consider the case where a common display signal as shown in FIG. 19 is given to the display devices 210 and 220. This display signal consists of commands No. 1 to No. 6, and all the commands are commands of the divisional level n=2. For example, the command No. 1 indicates an instruction "to divide the screen into sixteen blocks and turn the pixels on belonging to the block positioned at the first row and the second column." When these commands are given to the display device 210, a display state as shown in FIG. 20A is obtained. Namely, six pixels in total indicated by addresses of the commands No. 1 to No. 6 are placed in a light emitting state. On the contrary, in the case where these commands are given to the display device 220, it could not cope with such situations by the fundamental operation which has been described above. The reason thereof is as follows. The command of the divisional level n=2 is based on the premise that the screen is divided into sixteen blocks. However, since only four pixels (electric bulbs) exist in the display device 220, an electric bulb does belong to plural blocks.

In the above mentioned case, a divisional mode indicated by the designated divisional level is finer than the actual display elements so that when division is made on the basis of this divisional mode, portions of an electric bulb respectively belong to plural different blocks. In such a case, it is sufficient to perform an operation to make a combined data on the basis of respective data corresponding to these plural blocks and to vary the display state of the electric bulb on the basis of this combined data. For example, the electric bulb positioned at the left and upper portion of the display device 220 shown in FIG. 16B belongs to four blocks indicated by addresses "0000", "0001", "0010", "0011" at the divisional level n=2. In accordance with the display signal of FIG. 19, an instruction for light emitting is given with respect to three ("0001", "0010", "0011") of these four blocks and an instruction for non-light emitting is given with respect to the remaining one ("0000"). Supposing that the light emitting state is defined as a 100% luminous state and the non-light emitting state is defined as a 0% luminous state, the electric bulb positioned at the left and upper portion of the display device 220 should be a 75% luminous state, because a combined data of 75% is obtained by the operation of 3/(3+1)=75%. Thus, it is sufficient to turn ON the electric bulb in the 75% luminous state. Similarly, with respect to the electric bulb positioned at the left and lower portion of the display device 220 shown in FIG. 16B, it is sufficient to turn ON the electric bulb in a 25% luminous state based on a combined data of 25% which is obtained by an operation. Further, with respect to the electric bulb positioned at the right and lower portion, it is sufficient to turn ON the electric bulb in a 50% luminous state based on a combined data of 50% which is obtained by an operation. FIG. 20B is a view showing the state where such operations are performed to turn ON the electric bulbs in predetermined luminance values.

As stated above, in this embodiment, when a display signal having a higher resolution than the resolution of the corresponding display device is delivered, an operation to obtain a combined data as described above is performed. Therefore, it is always possible to carry out a proper display process based on the particular resolution of the corresponding display device, even if various display signals with various resolutions are delivered.

Let show another example. Assuming that, a display device 310 comprised of sixty four pixels as shown in FIG. 21A, a display device 320 comprised of sixteen pixels as shown in FIG. 21B, a display device 330 comprised of four pixels as shown in FIG. 21C, and a display device 340 comprised of one pixel as shown in FIG. 21D are prepared. Then, a common display signal as shown in FIG. 22 is assumed to be given to these four kinds of display devices. This display signal consists of commands of the divisional level n=2 or n=3, and a data is either light-emitting "1" or non-light emitting "0" indicated by one bit. If such a display signal is delivered to the display device 310, a character of "I" of alphabet is displayed as shown in FIG. 21A. In this case, electric bulbs constituting pixels in the light emitting state are turned ON in the state of luminance of 100%. However, in the display device 320, as shown in FIG. 21B, an operation for obtaining a combined data is performed with respect to pixels related to the commands of the divisional level n=3. Thus, electric bulbs constituting pixels in the light emitting state are turned ON in the state of luminance of any one of 25%, 50% and 100%. Further, in the display device 330, as shown in FIG. 21C, an operation for obtaining a combined data is performed for every pixels. Thus, electric bulbs constituting pixels in the light emitting state are turned ON in the state of luminance of 1/16 or 7/16 with respect to the maximum luminance. In the display device 340, as shown in FIG. 21D, a sole electric bulb is turned ON in the state of luminance of 16/64 with respect to the maximum luminance. In other words, the display state shown in FIG. 21D is a display state obtained by averaging the display state shown in FIG. 21A over the entire screen.

It is to be noted that while the above-described example is based on the premise that luminance of the electric bulb can be controlled stepwise to some degree, in the case where the electric bulbs can be controlled only with binary states of light emitting and non-light emitting, a control procedure may be determined in advance in a manner such that when a combined data indicating luminance of 50% or more is obtained, the electric bulbs should be turned ON, and when a combined data indicating luminance of less than 50% is obtained, the electric bulbs should be turned OFF.

Moreover, in order to add a special performance effect, the following approach may be employed. That is, plural display signals having different divisional levels on the basis of the same picture image are prepared in advance in the control unit 40. Then these display signals are delivered in order from the display signal coarse in division to the display signal fine in division. For example, display signals as shown in FIG. 23 are prepared. In this case, the command No. 1 is a command of the divisional level n=0, the commands No. 2 to No. 5 are commands of the divisional level n=1, the commands No. 6 to No. 21 are commands of the divisional level n=2, and the command No. 22 and the succeeding commands are commands of the divisional level n=3. In addition, the command group of the divisional level n=0, the command group of the divisional level n=1, the command group of the divisional level n=2 . . . are all prepared on the basis of the same picture image, and they are commands for respectively representing the same picture image in the state of different resolutions. If such display signals are prepared and are delivered in order from the display signal of coarse division to the display signal of fine division in such a manner that command No. 1 is first delivered at time t1, commands No. 2 to No. 5 are delivered at time t2, commands No. 6 to No. 21 are delivered at time t3, and command No. 22 and the succeeding commands are delivered at time t4. When such an approach is employed, a special representation effect is added such that the same picture is displayed vaguely at low resolution at first on the screen and the resolution gradually becomes higher so that a clear picture is ultimately obtained.

As previously mentioned, if the length of address/data is fixed, a long data length can be ensured in a display state of low resolution (low divisional level). In the example shown in FIG. 23, address/data is set to have seven bits of a fixed length. For this reason, in the case of the command No. 1, all of the seven bits can be allocated to data bits, but a length of data bits is gradually decreased with increasing divisional level. That is, five bits are allocated to the data bits in the case of the command No. 2 to No. 5, three bits in the case of the commands No. 6 to No. 21, and one bit in the case of the command 22 and the succeeding commands. Accordingly, in the case of a vague picture image of low resolution, precise color representation can be made. According as the resolution is improved to more degree so that a picture image becomes clear, the color representation becomes poor. However, as previously mentioned, such a property is in conformity with the pattern recognition characteristic by the eye of the human being, so disagreement of feeling does not take place.

In addition, according to the present invention, picture processing such as enlargement, shrinkage, movement or rotation, etc. can be easily implemented as occasion demands, because a picture image is represented based on a display signal with a particular format described above. Namely, since this display signal includes information of addresses indicating individual pixel positions, it can be caused to directly undergo digital operation. Particularly, with respect to an operation to carry out enlargement of 4 times of picture image or shrinkage into 1/4 thereof, it is sufficient to only carry out simple processing to shift address in any direction by 2 bits.

§4 Application to Display Moving Picture

While the example where the display device according to this invention is used to display a still picture has been mainly described, the display device of this invention is suitable also for utilization to display a moving picture. As previously described, since a scanning processing for individual pixels is not required in the display device of this invention, it is possible to efficiently instruct the display state. Namely, in the case where the display state is partially changed, it is sufficient to give instructions only with respect to such a change portion. As a result, a rewrite operation of picture on the screen can be carried out at a high speed. This is very convenient for carrying out moving picture display.

Figure 24A:
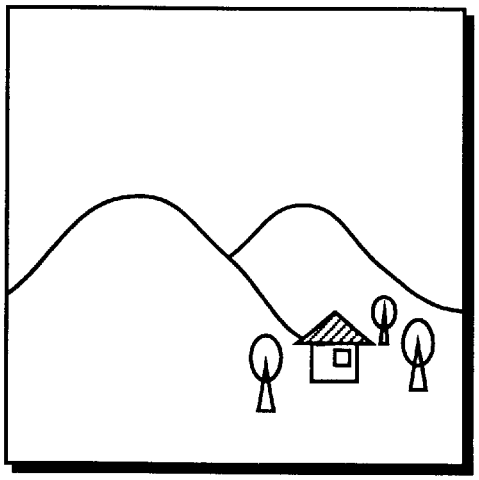
FIGS. 24A to 24D are views showing states of moving picture display in a display device according to this invention.
Figure 24B:
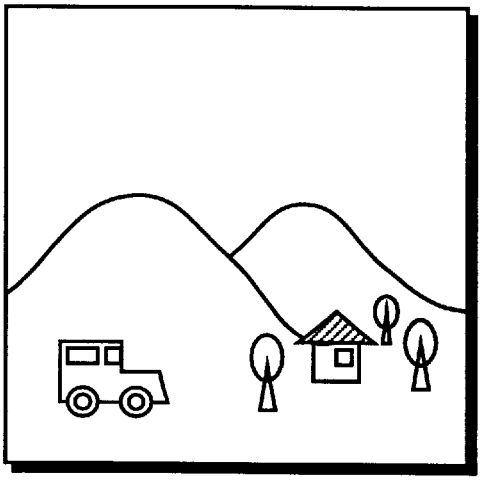
Figure 24C:
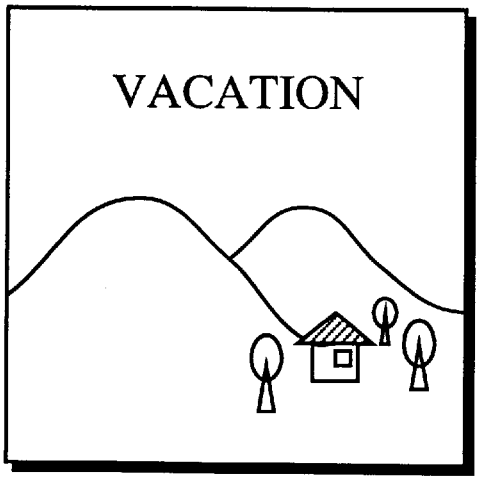
Figure 24D:
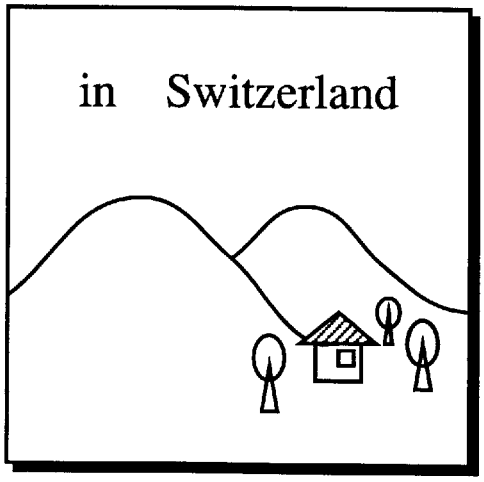

FIGS. 24A to 24D are views showing states of moving picture display in the display device according to this invention. Assuming that, a background picture image as shown in FIG. 24A is displayed and then a moving vehicle is shown as shown in FIG. 24B. In order to show such a moving picture, it is sufficient to give commands for rewrite operations only with respect to pixels in the vicinity of the vehicle being moved. Moreover, as shown in FIG. 24C and FIG. 24D, in the case where a character string is superimposed on a background picture image and only a portion of the character string should be sequentially changed, it is sufficient to give commands for rewrite operations only with respect to pixels in the vicinity of the character string.

As stated above, in the display device according to this invention, when the control unit 40 generates and delivers a series of display signals with respect to the portions where a change in time takes place on the basis of a series of picture images, it is possible to provide a high speed moving picture on the screen.

It is to be noted that in the case where the divisional level that the given command indicates is finer than the resolution of the hardware of the corresponding display device as described in the Chapter §3, it is necessary to carry out an operation to combine plural data to obtain a new combined data. However, in the case of displaying a moving picture, a sufficient operation time required for preparing combined data might not be ensured. Primarily, the moving picture is obtained by successively displaying plural still pictures one after another, and a moving picture is represented by repeating an operation such as to display a first still picture on the basis of a first display signal and subsequently to display a second still picture on the basis of a second display signal, etc. However, there can be instances where while a display signal of very high divisional level is given as a first display signal and an operation for preparing a combined data is being executed, a second display signal is given before that operation has not yet been completed. In such a case, if this second display signal indicates a divisional level lower than that of the first display signal, it is desirable to stop the operation based on the first display signal and start the operation based on the second display signal. And if the divisional level of the second display signal is higher than that of the first display signal in a manner opposite to the above, it is desirable to continue the operation based on the first display signal as it is and thereafter to begin processing for the second display signal.

When such a processing is carried out, a coarse picture image of a low divisional level is preferentially displayed with respect to the portion where a change in time is great, and a picture image of high quality of a high divisional level is displayed only with respect to the portion where a change in time is gentle. Such a display method is in conformity with the pattern recognition characteristic by the eye of the human being. Namely, the eye of the human being can carry out fine pattern recognition with respect to the portion where movement is small, but cannot carry out fine pattern recognition with respect to the portion where movement is great. Accordingly, even when there is employed such an approach to carry out fine picture display with respect to the portion where movement is small even if it takes much operation time, and to carry out coarse picture display with respect to the portion where movement is great to avoid long time operation, disagreement of feeling does not take place for the eye of the human being.

Figure 25:
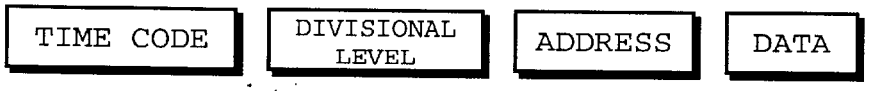
FIG. 25 is a view showing a format used in the display device according to this invention, in which a time code is added to a display signal for instructing display content.

Finally, a modified format in which a time code is further added to the fundamental format of FIG. 3 is shown in FIG. 25. When a time code is added to respective commands for displaying a moving picture, it is possible to synchronize display timings between individual pixels. For example, as it has been described, in order to obtain a display pattern as shown in FIG. 4A, it is sufficient to deliver a display signal consisting of eight commands in total shown in the lower parts of FIGS. 4B, 4C, 4D. However, in order to obtain this display pattern at a particular moment on the screen, it is necessary to synchronize display operations in time based on these eight commands. By adding the same time code to the leading portions of these eight commands and delivering a common clock signal to the individual display elements or controllers, the respective display elements can simultaneously execute the display operation at the time designated by the time code.

As a time code, codes indicating an actual time may be used, or codes indicating relative time relationship may be used. In short, any codes capable of indicating execution times of individual commands may be used. In the case where a moving picture image, which is inputted by video camera, etc., is recorded as a series of still pictures every 1/60 sec., time codes indicating numbers of these still pictures such as 1, 2, 3, . . . may be used. In this case, a rewrite operation of a still picture is carried out at a timing every 1/60 sec. Of course, it is sufficient to use a signal indicating only a changed portion with respect to a still picture which has been displayed immediately before as a display signal indicating a next still picture.

When time codes are added in this way, it is possible to freely set actual times at which respective still pictures are to be displayed. Therefore, it is not necessarily required to supply display signals on the real time basis. An operation speed of a semiconductor element such as a CPU, etc. is being improved years by years. Accordingly, it has become possible to supply display signals at a very high speed. In view of the above, if a memory device, etc. for storing commands is provided inside the display device, it becomes possible to deliver commands from the control unit irrespective of the actual display speed.

Moreover, the time code may be used for allowing plural display devices having different resolutions to select command in conformity with the own resolution. For example, in the display signal shown in FIG. 23, the same picture image is represented by different resolutions as previously described. Namely, the command No. 1 is a display signal corresponding to the resolution of the divisional level n=0, the commands No. 2 to No. 5 are display signals corresponding to the resolution of the divisional level n=1, the commands No. 6 to No. 21 are display signals corresponding to the resolution of the divisional level n=2, and the command No. 22 and the succeeding commands are display signals corresponding to the resolution of the divisional level n=3. Accordingly, in the case of the display device 310 shown in FIG. 21A, it is most efficient to select the command No. 22 and the succeeding commands to display a picture image corresponding thereto at the resolution of the divisional level n=3. In the case of the display device 320 shown in FIG. 21B, it is most efficient to select commands No. 6 to No. 21 to display a picture image corresponding thereto at the resolution of the divisional level n=2. Similarly, in the case of the display device 330 shown in FIG. 21C, it is most efficient to select commands No. 2 to No. 5 to display a picture image corresponding thereto at the resolution of the divisional level n=1. In the case of the display device 340 shown in FIG. 21D, it is most efficient to select the command No. 1 to display a picture image corresponding thereto at the resolution of the divisional level n=0.

In such a case, it is preferable to respectively add the same time code to a series of command groups shown in FIG. 23. When plural commands which have the same time code but have different divisional levels from each other are received, it is sufficient for the display device to select a command having a proper resolution, i.e., a command having a divisional level in conformity with its own arrangement of display elements and execute only the operation of the selected command. For example, when the display device 330 shown in FIG. 21C receives a series of commands shown in FIG. 23, it selects only the commands No. 2 to No. 5 among them and executes only these selected commands.

INDUSTRIAL APPLICABILITY

The display device according to this invention can be widely utilized for electric bulletin boards or display devices in which a large number of electric bulbs, light emitting diodes or rotational panels, etc. are arranged. The device can be also utilized for liquid crystal display devices, etc. in which a large number of transistors are arranged in a matrix form.

What is claimed is:

1. Method for controlling a display device including plural display elements which constitute a two-dimensional pixel arrangement and a controller to control the respective display elements, said method comprising steps of:

defining plural kinds of divisional modes for dividing the two-dimensional pixel arrangement into plural software blocks so that the respective divisional modes are represented by divisional level information indicating fineness of division;

preparing a plurality of display signals including divisional level information, address information and data information;

delivering said display signals to the controller; and operating the controller to execute a display operation for changing a display state of a display element or elements belonging to a particular software block indicated by the address information so that the display state is changed to a new state indicated by the data information, said particular software block being selected from among the plural software blocks which are obtained when the two dimensional pixel arrangement is divided by a divisional mode indicated by the divisional level information; and wherein a divisional mode indicated by a divisional level n is defined in which the two-dimensional pixel arrangement is divided by $2^n$ in length and breadth directions so that $2^{2n}$ number of software blocks are obtained and N kinds of divisional modes are defined with respect to n=1,2, . . . ,i, . . . ,N.

2. Method for controlling a display device as set forth in claim 1:

wherein, with respect to four software blocks obtained in a divisional mode indicated by a divisional level n=1, they are respectively indicated by addresses consisting of 2 bits of 00, 01, 10, 11; and wherein, with respect to $2^{2i}$ software blocks obtained in a divisional mode indicated by a divisional level n=i, they are respectively indicated by addresses obtained by adding any one of 00, 01, 10, 11 to low order sides of addresses indicating $2^{2(i-1)}$ software blocks obtained in a divisional mode indicated by a divisional level n=(i−1).

3. Method for controlling a display device as set forth in claim 2:

wherein divisional level information, address information and data information are respectively represented by bit or bits, a bit length of the divisional level information being fixed and a sum of a bit length of the address information and a bit length of the data information being fixed, and the bit length of the address information is recognized on the basis of the divisional level information.

4. Method for controlling a display device as set forth in claim 1:

wherein when the two-dimensional pixel arrangement is divided based on a divisional mode finer than a display element so that portions of a display element respectively belong to plural different software blocks, an operation to obtain uniformed combined data information is executed on the basis of respective data information corresponding to said plural different software blocks and a display state of the display element is changed on the basis of said combined data information.

5. Method for controlling a display device as set forth in claim 4:

wherein in a time period during which an operation for obtaining uniformed combined data information is executed on the basis of a first display signal delivered for a purpose of changing a display state of a specific display element, when a second display signal for a purpose of changing a display state of said specific display element is delivered and said second display signal indicates a division coarser than that of said first display signal, said operation based on said first display signal is stopped and a new operation based on said second display signal is executed.

6. Method for controlling a display device as set forth in claim 1:

wherein a display signal is prepared which includes divisional level information, address information, data information and a time code; and wherein the controller is functioned so that when it is supplied with the display signal, it changes a display state at a timing synchronous with the time code.

7. Method for controlling a display device as set forth in claim 6:

wherein when the controller is supplied with plural display signals including a same time code and different divisional levels from each other, the controller is functioned to select a display signal having a divisional level in conformity with a number of display elements constituting the two-dimensional pixel arrangement among the plural display signals and execute only an operation based on the selected display signal.

8. Method for controlling a display device as set forth in claim 1:

wherein plural display signals are prepared which are different in divisional levels on the basis of a same picture image and said plural display signals are delivered in order from a display signal coarse in division to a display signal fine in division.

9. Method for controlling a display device as set forth in claim 1:

wherein a display signal is prepared which indicates a state of a portion of a screen where a change takes place with respect to a series of picture images and said display signal is delivered to the controller to provide a moving picture.

* * * * *